US011910885B2

(12) United States Patent
Zinner et al.

(10) Patent No.: US 11,910,885 B2
(45) Date of Patent: Feb. 27, 2024

(54) ARTICLE OF FOOTWEAR INCORPORATING WINDING ELEMENTS

(71) Applicant: PUMA SE, Herzogenaurach (DE)

(72) Inventors: Sabrina Zinner, Nuremberg (DE); Andreas Siegismund, Rueckersdorf (DE); Matthias Hartmann, Forchheim (DE)

(73) Assignee: PUMA SE, Herzogenaurach (DE)

( * ) Notice: Subject to any disclaimer, the term of this patent is extended or adjusted under 35 U.S.C. 154(b) by 50 days.

(21) Appl. No.: 17/063,316

(22) Filed: Oct. 5, 2020

(65) Prior Publication Data

US 2022/0104588 A1 Apr. 7, 2022

(51) Int. Cl.
*A43D 59/00* (2006.01)
*A43D 11/02* (2006.01)

(52) U.S. Cl.
CPC ..... *A43D 59/00* (2013.01); *A43D 11/02* (2013.01)

(58) Field of Classification Search
CPC ..... A43B 1/04; A43B 23/02; A43B 23/04; A43B 3/12; A43B 3/126; A43B 23/027; A43D 3/02; A43D 3/022; A43D 11/01; A43D 59/00; D04C 7/00; D04C 3/12
USPC ..... 36/11.5; 87/34
See application file for complete search history.

(56) References Cited

U.S. PATENT DOCUMENTS

| | | | | |
|---|---|---|---|---|
| 2,126,094 | A * | 8/1938 | Daniels | A43B 3/122 D2/918 |
| 2016/0166000 | A1* | 6/2016 | Bruce | A43B 23/0225 87/34 |
| 2016/0166007 | A1* | 6/2016 | Bruce | A43B 23/042 36/31 |
| 2016/0206044 | A1* | 7/2016 | Dimoff | A43B 5/06 |
| 2016/0242510 | A1* | 8/2016 | Fisher | A43D 9/00 |
| 2017/0035149 | A1 | 2/2017 | Bruce et al. | |
| 2018/0064210 | A1 | 3/2018 | Turner et al. | |
| 2018/0271216 | A1* | 9/2018 | La O' | A43B 23/027 |
| 2018/0361683 | A1 | 12/2018 | Downs et al. | |
| 2019/0098955 | A1* | 4/2019 | Bruce | A43B 23/04 |
| 2019/0307208 | A1* | 10/2019 | Corcoran-Tadd | A43B 13/14 |
| 2020/0154816 | A1* | 5/2020 | Gaba | A43B 23/0235 |

FOREIGN PATENT DOCUMENTS

EP 3549470 A1 10/2019

OTHER PUBLICATIONS

International Search Report and Written Opinion of the International Searching Authority from corresponding PCT Application No. PCT/IB2021/058645 dated Dec. 7, 2021 (15 pages).

* cited by examiner

*Primary Examiner* — Aiying Zhao
(74) *Attorney, Agent, or Firm* — Quarles & Brady LLP

(57) ABSTRACT

A method of manufacturing an upper for an article of footwear includes providing a frame and a support component, and defining a plurality of anchor points on the frame. The method further includes winding a first continuous thread around the plurality of anchor points defined on the frame and around the support component so that the first continuous thread extends from the frame to the support component, and securing the first continuous thread.

19 Claims, 19 Drawing Sheets

SECTION AA'

ARTICLE OF FOOTWEAR INCORPORATING WINDING ELEMENTS

CROSS REFERENCE TO RELATED APPLICATIONS

Not applicable

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to an article of footwear and, more particularly, to an article of footwear having at least a portion thereof incorporating winding elements. Further, the present disclosure relates generally to systems and methods for manufacture of winding elements for an article of footwear.

2. Description of the Background

Many conventional shoes or articles of footwear generally comprise an upper and a sole attached to a lower end of the upper. Conventional shoes further include an internal space, i.e., a void or cavity, which is created by interior surfaces of the upper and sole, that receives a foot of a user before securing the shoe to the foot. The sole is attached to a lower surface of the upper and is positioned between the upper and the ground. As a result, the sole typically provides stability and cushioning to the user when the shoe is being worn and/or is in use. In some instances, the sole may include multiple components, such as an outsole, a midsole, and an insole. The outsole may provide traction to a bottom surface of the sole, and the midsole may be attached to an inner surface of the outsole, and may provide cushioning and/or added stability to the sole. For example, a sole may include a particular foam material that may increase stability at one or more desired locations along the sole, or a foam material that may reduce stress or impact energy on the foot and/or leg when a user is running, walking, or engaged in another activity.

The upper generally extends upwardly from the sole and defines an interior cavity that completely or partially encases a foot. In most cases, an upper extends over instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, the tongue being provided to allow for adjustment of shoe tightness. The tongue may further be manipulable by a user to permit entry and/or exit of a foot from the internal space or cavity. In addition, the lacing system may allow a user to adjust certain dimensions of the upper and/or the sole, thereby allowing the upper to accommodate a wide variety of foot types having varying sizes and shapes.

The upper may comprise a wide variety of materials, which may be chosen based on one or more intended uses of the shoe. The upper may also include portions comprising varying materials specific to a particular area of the upper. For example, added stability may be desirable at a front of the upper or adjacent a heel region so as to provide a higher degree of resistance or rigidity. In contrast, other portions of a shoe may include a soft woven textile to provide an area with stretch-resistance, flexibility, air-permeability, or moisture-wicking properties.

Typically, these regions of enhanced stability may be provided by using different textile constructions or compositions. For example, knitting is commonly used to create uppers for articles of footwear. To create regions of enhanced stability, regions of the upper may comprise a denser knitting construction, include different materials, or include varying knit techniques, such as, e.g., ribs. Further, woven materials are commonly used to create uppers. To create regions of enhanced stability in a woven upper, regions may comprise a denser weave, higher denier yarns, or incorporate different materials. Additionally, for uppers comprising knit and/or woven materials, a common technique for enhancing stability in particular regions includes adding thermoplastic layers, i.e., skin, onto a surface of the material. However, conventional methods of manufacturing uppers with a plurality of performance characteristics can require lengthy manufacturing timelines. Additionally, existing manufacturing methods can limit opportunities for experimentation and incremental design changes. That is, making minor modifications to an article of footwear may require substantial changes to the manufacturing mechanism. Therefore, a need exists for methods of manufacturing of an article of footwear, with one or more materials and constructions configured to provide selective performance characteristics, that can expedite the manufacturing process while enabling design adjustments and experimentation.

SUMMARY

In some embodiments, a method of manufacturing an upper for an article of footwear can include providing a frame and a support component, defining a plurality of anchor points on the frame, winding a first continuous thread around the plurality of anchor points defined on the frame and around the support component so that the first continuous thread extends from the frame to the support component, and securing the first continuous thread.

In some embodiments, a method of manufacturing an article of footwear can include providing a shoe last and a sole, the sole having a first surface and a second surface, the first surface being configured to project toward and contact the shoe last, and the second surface being configured to project opposite the first surface. The method can further include defining a plurality of anchor points on the shoe last, winding a first continuous thread around the plurality of anchor points on the shoe last and around the sole so that the first continuous thread wraps around and contacts the second surface of the sole, and curing the first continuous thread so it holds a rigid shape.

In some embodiments, a method of manufacturing an upper for an article of footwear can include providing a first frame and a second frame, defining a plurality of anchor points on the first frame and the second frame, winding a first continuous thread around the plurality of anchor points on the first frame and around the plurality of anchor points on the second frame so that the first continuous thread extends between the first frame and the second frame to form a textile component, and curing the textile component so it holds a rigid shape.

In some embodiments, a method of manufacturing an upper for an article of footwear can include providing a support component, depositing a first continuous thread on the support component along a first direction, securing the first continuous thread at a point along the first direction, and depositing the first continuous thread on the support component along a second direction that is different from the first direction. The method can further include securing the first continuous thread along the first direction and can include setting the first continuous thread so that it holds a shape.

In some embodiments, a method of manufacturing an upper for an article of footwear can include providing a support component, providing a base layer onto the support component, depositing a first continuous thread onto the base layer along a first direction, securing the first continuous thread at a point along the first direction, and depositing the first continuous thread on the support component along a second direction that is different from the first direction.

In some embodiments, a method of manufacturing an article of footwear can include providing a shoe last and a stiffening plate. The stiffening plate includes a first surface and a second surface, the first surface being configured to project toward and contact an external surface of the shoe last, and the second surface being configured to project opposite the first surface. The method can further include winding one or more continuous strands around the shoe last and the stiffening plate so that the one or more continuous strands wrap around the external surface of the shoe last and the second surface of the stiffening plate. Further, the method can include curing the one or more continuous strands so they maintain a rigid, three-dimensional shape and are secured to the stiffening plate.

Other aspects of the articles of footwear described herein, including features and advantages thereof, will become apparent to one of ordinary skill in the art upon examination of the figures and detailed description herein. Therefore, all such aspects of the articles of footwear are intended to be included in the detailed description and this summary.

DETAILED DESCRIPTION OF THE DRAWINGS

Figure 1:
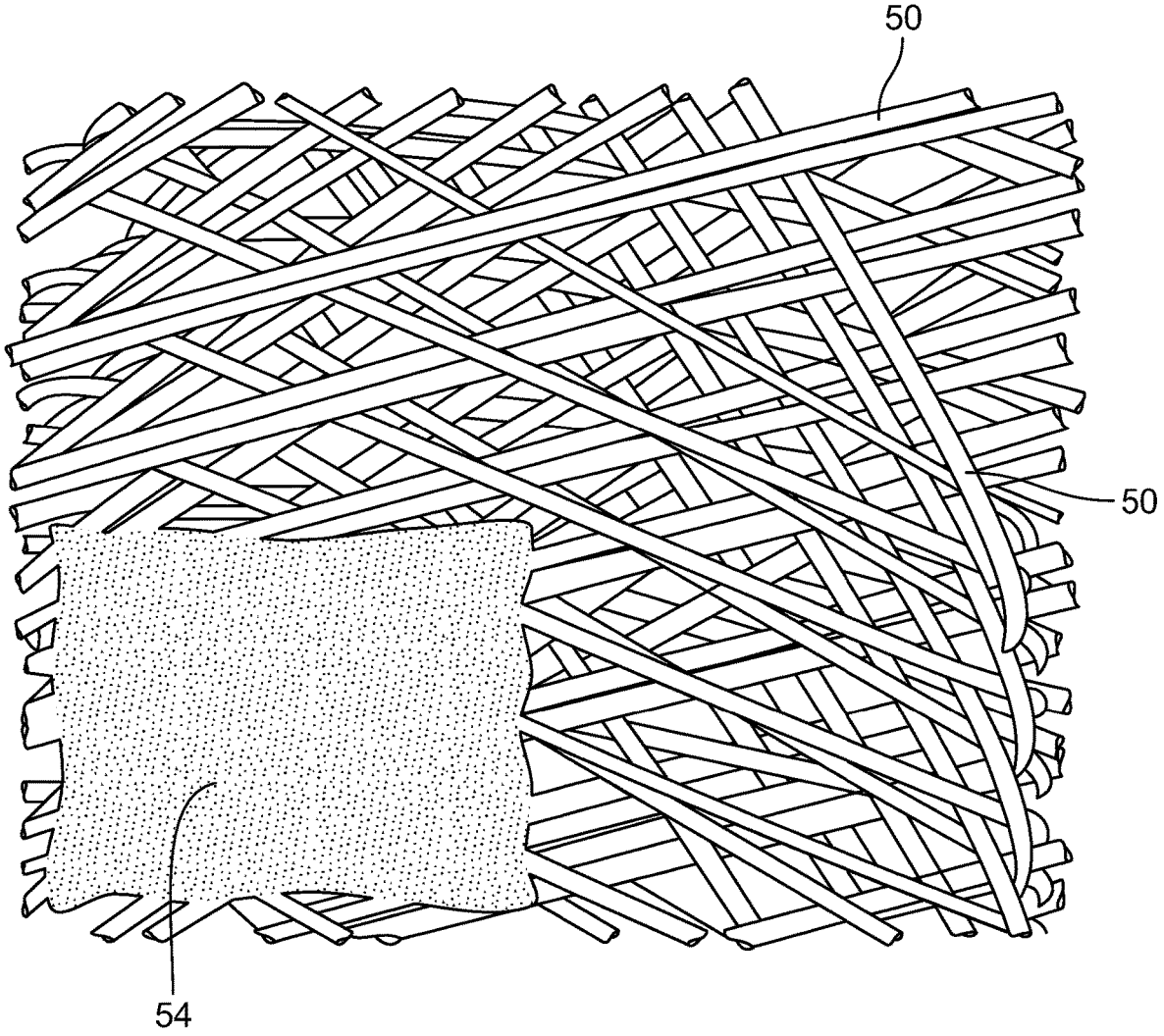
FIG. 1 is a plan view of a wound element with a fused region.

The following discussion and accompanying figures disclose various embodiments or configurations of a shoe incorporating winding elements. Although embodiments are disclosed with reference to a sports shoe, such as a running shoe, tennis shoe, basketball shoe, etc., concepts associated with embodiments of the shoe may be applied to a wide range of footwear and footwear styles, including basketball shoes, cross-training shoes, football shoes, golf shoes, hiking shoes, hiking boots, ski and snowboard boots, soccer shoes and cleats, walking shoes, and track cleats, for example. Concepts associated with embodiments of the shoe or the winding element may also be applied to articles of footwear that are considered non-athletic, including dress shoes, sandals, loafers, slippers, and heels. In addition to footwear, particular concepts described herein, such as the winding element, may also be applied and incorporated in other types of articles, including apparel or other athletic equipment, such as helmets, padding or protective pads, shin guards, and gloves. Even further, particular concepts described herein may be incorporated in cushions, backpacks, suitcases, backpack straps, golf clubs, or other consumer or industrial products. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values ±5% of the numeric value that the term precedes.

The term "wind" or variations thereof, as used herein, refer to an act or instance of wrapping or moving an element around a component or three-dimensional body. For example, in some embodiments, "winding" may refer to the act of wrapping one or more continuous threads around one or more anchor points so that the one or more threads contact an underlying component or body along a length thereof. In some embodiments, "winding" may be the act of wrapping one or more continuous threads entirely or partially around an underlying component or body such that the thread contacts a surface of the underlying component or body along a length thereof.

The present disclosure is directed to an article of footwear and/or specific components of the article of footwear, such as an upper and/or a sole or sole structure, having a winding element. The winding element may be formed using an existing process known as filament winding, or fiber winding. Generally, this process may comprise winding filaments, or fibers, under tension over a rotating mandrel, or other underlying structure. This process may be particularly useful for manufacturing hollow structures, such as, e.g., cylinders or vessels. Further, this process can be a fast and efficient manufacturing process, making it particularly useful for manufacturing high-volume consumer products.

Common filaments used for filament winding include glass or carbon fibers, which may be impregnated in a bath with resin before or as the filaments are being wound onto the mandrel. The impregnated filaments may be cured, fused, or bonded to create the winding element. Filaments for use in the fiber winding process may also be strands, threads, cords, ribbon, tape, bands, or other elongate elements or fibers. According to some embodiments, the filaments may be mono-filament or multi-filament strands or structures, and filaments used in some embodiments may be woven, braided, knit, or wound multi-strand structures. Throughout the specification, filaments for use in winding elements are referred to as "strands," however, the term "strand" may be interchangeable with filament, thread, cord, ribbon, tape, band, elongate element, fiber, or the like. Generally, filaments used in embodiments of the present disclosure may be selected to provide various characteristics. For example, the filaments used may be chosen to provide a particular level of support, stretch, strength, stiffness, stability, warmth, and/or breathability to the article of footwear, with the choice of fiber material(s), the thickness of the fiber, the structure of the fiber, the orientation of the fiber on the support structure, and/or the treatment of the fiber after or during the winding process. Examples of materials that may be used include, but are not limited to, natural fibers, thermoplastics, e.g., TPU, polyester, etc., hot melt strands or tape, woven threads, and/or adhesive tape.

A thread supply system may be used to dispense one or more fibers or strands during a winding process according to embodiments of the present disclosure. Some embodiments may use a thread supply system comprising one or more moveable arms that are configured to dispense one or more continuous fibers around an underlying structure. The one or more movable arms may automatically dispense the fibers at a preset, adjustable rate while concurrently moving relative to the underlying support structure. Additionally or alternatively, one or more fibers or strands may be dispense via a static system. That is, strands may be automatically dispense from a static supply system, and an underlying support structure may rotate or translate relative to the supply system so that the one or more fibers may wrap around the underlying support structure. Additionally or alternatively, a thread supply system may be manual. For example, one or more continuous strands may be manually wrapped around an underlying support structure.

The filament winding technique as discussed herein can include winding one or more continuous filaments around one or more support elements and/or one or more anchor points to create a thread pattern. For example, winding the one or more continuous threads may include wrapping a continuous thread around a first anchor point, extending that continuous thread to a second anchor point, wrapping that continuous thread around the second anchor point, and so on for any number of anchor points. In some instances, a continuous thread may be wrapped around the same anchor point more than once. For example, a continuous thread may wrap around a first anchor point, extend to a second anchor point, wrap around the second anchor point, and extend back to the first anchor point to wrap around the first anchor point again. An anchor point may be a pin secured to or in the underlying support structure. One or more continuous threads, thus, may be wrapped around one or more anchor points to facilitate a change in winding direction. Additionally or alternatively, screws, hooks, pegs, or the like may be used as anchor points for manufacturing winding elements according to embodiments of the present disclosure. Furthermore, as will be described in greater detail herein, an anchor point may be established by a fiber itself. For example, a portion of the fiber may be stabilized, cured, glued, or fixed to an underlying structure, thereby enabling the fiber to be wound in a different direction from that portion.

Patterns of winding elements according to embodiments of the present disclosure may be designed to provide particular performance benefits or characteristics. For example, one or more continuous threads may be wound in order to tune, for example, stability, strength, flexibility, rigidity, breathability, comfort, abrasion resistance, texture, and/or durability in different regions of a winding element. Thus, winding one or more continuous threads as described herein may facilitate and/or enhance customization capabilities for one or more components of an article of footwear. By selective placement of one or more anchor points, and by selectively winding one or more continuous threads about the one or more anchor points, the winding element may be tailored for a particular use or user.

The number and configuration of continuous threads wound around the anchor points, and the material of the one or more continuous threads may be selected to provide particular characteristics in an article of footwear. For example, a continuous strand may be a filament, thread, fiber, yarn, knitted element, cable, cord, fiber tow, tape, ribbon, monofilament, braid, string, or the like composed of a variety of materials. A strand may be a polymer thread composed at least in part of a polymer material. In some embodiments, a polymer thread may be composed entirely of one or more polymeric materials. Alternatively, a polymer thread may include a polymeric material coated around a core. A polymer thread may include a polymer core coated, covered, or encapsulated with a non-polymeric material, for example. Further, in some embodiments, a polymer thread by be a braided thread with one or more braids composed of a polymeric material, which may be thermoplastic materials. Additionally or alternatively, a continuous thread may be a thread coated with an activatable adhesive, for example, a heat activated adhesive, such as thermoplastic polyurethane (TPU), recycled TPU, rubber, or silicone, for example. In some instances, a continuous strand may include a polymeric material that is a photo-reactive (IR or UV light reactive) polymeric material, such as, e.g., photo-reactive TPU, and/or soluble, e.g., water soluble. Moreover, a continuous thread may include polymer threads with a coated core. Suitable materials for the core include, but are not limited to, polyester, nylon, ultra-high molecular weight polyethylene, carbon fiber, KEVLAR®, a bioengineered woven material, a knit material, layered materials (e.g., synthetic spider silk), woven materials, layered plant based materials, knit or layered recycled and/or extruded plastics, cotton, wool, and natural or artificial silk. Polymer threads may be thermoplastic polyurethane coated polyester threads. Additionally or alternatively, polymer threads may be a thermoplastic melt yarn, polymer yarn with non-melt core, and other similar types of yarn. Furthermore, embodiments of the present disclosure may include a continuous thread that is a non-polymer thread composed of non-polymer materials, such as carbon fiber, cotton, wool, or silk.

In some embodiments, the winding element may be fabricated as a discrete component by having threads that are cured, or otherwise stabilized, to define a formed, rigid, or fixed shape. As used herein, "curing," "bonding," "stabilizing," "securing," and variations thereof generally refer to an act or instance of changing a characteristic of a material, and may be used interchangeably. For example, FIG. 1 illustrates a plurality of strands 50 that comprise a heat responsive material that cures, or physically changes, in response to heat. In the illustrated example, the strands 50 are configured to melt in response to heat, thereby creating a substantially uninterrupted, fused region 54 of material. Generally, in this instance, one or more continuous strands may be wound around an underlying support structure, heated to initiate curing, and removed from the underlying support structure once substantially cured. A result of this process may be a three-dimensional winding element that substantially retains a shape of the underlying support structure after it is removed therefrom. Embodiments of the present disclosure are not limited to heat-induced curing processes. In some embodiments, for example, a winding element may be bonded, cured, fused, or otherwise stabilized, via adhesive, one or more bonding layers, one or more curing agents, e.g., chemical curing agents, conductive or convective thermal heat, e.g., in a heat press or oven, IR heating, ultraviolet curing, laser heating, microwave heating, steam, a mechanical fastener, e.g., a clip, hook and loop fasteners, needling-punching, hydro-entanglement, ultrasonic/vibratory entanglement, felting, or knitting. Further, some embodiments may require particular atmospheric conditions to initiate curing or bonding, such as low temperatures, low pressure, high pressure, high humidity, low humidity, for example. In one particular example, a winding element may include one or more continuous threads that are impregnated with an adhesive agent. Thus, once one or more continuous threads are wound around an underlying support structure, the threads may stabilize or dry so they substantially retain a shape of the underlying support structure. Furthermore, in another example, a winding element may include one or more continuous strands that are impregnated with a curing agent and configured to cure once exposed to a reactive curing agent. The one or more continuous strands thus may be wound around an underlying support structure, coated or sprayed with the reactive curing agent, and thereby initiate the curing process. Once cured, the winding element may be removed from the underlying support structure. In some embodiments, one or more curing agents may be applied before, during, or after a winding process. Therefore, once cured, bonded, fused, or otherwise stabilized, winding elements according to embodiments of the present disclosure may be incorporated into an article of footwear, e.g., as an component of an upper or a sole structure.

In some embodiments, however, a winding element may be fabricated with one or more textile elements. For example, an underlying support structure may be covered or wrapped with one or more components, such as, e.g., layers of fabric, before one or more continuous strands are wrapped therearound. The one or more continuous threads, thus, may be bonded or fused to the one or more layers of fabric to create an integral component. Additionally or alternatively, the one or more continuous threads may be cured or stabilized with the one or more layers of fabric to form a substantially stiff or inelastic shape. Examples of underlying or base layers of fabric may include a knitted component, a woven textile, a non-woven textile, leather, mesh, suede, and/or a combination of one or more of the aforementioned materials or equivalents. Additionally or alternatively, embodiments may include a dissolvable underlying base material comprising a wax material, such as, e.g., paraffin wax, that may substantially dissolve when exposed to a dissolving medium, e.g., a liquid dissolving agent, thereby leaving only the threads or fibers. The knitted component may be made by knitting of yarn or fibers, the woven textile by weaving of yarn or fibers, and the non-woven textile by manufacture of a unitary non-woven web. Examples of knitted textiles include textiles formed by way of warp knitting, weft knitting, flat knitting, circular knitting, and/or other suitable knitting operations. A knit textile may have a plain knit structure, a mesh knit structure, and/or a rib knit structure, for example. Examples of woven textiles include, but are not limited to, textiles formed by way of any of the numerous weave forms, such as plain weave, twill weave, satin weave, dobbin weave, jacquard weave, double weaves, and/or double cloth weaves, for example. Examples of non-woven textiles include textiles made by air-laid and/or spun-laid methods, for example. Therefore, embodiments of the present disclosure may include a winding element having one or more of a variety of textile components.

Figure 2:
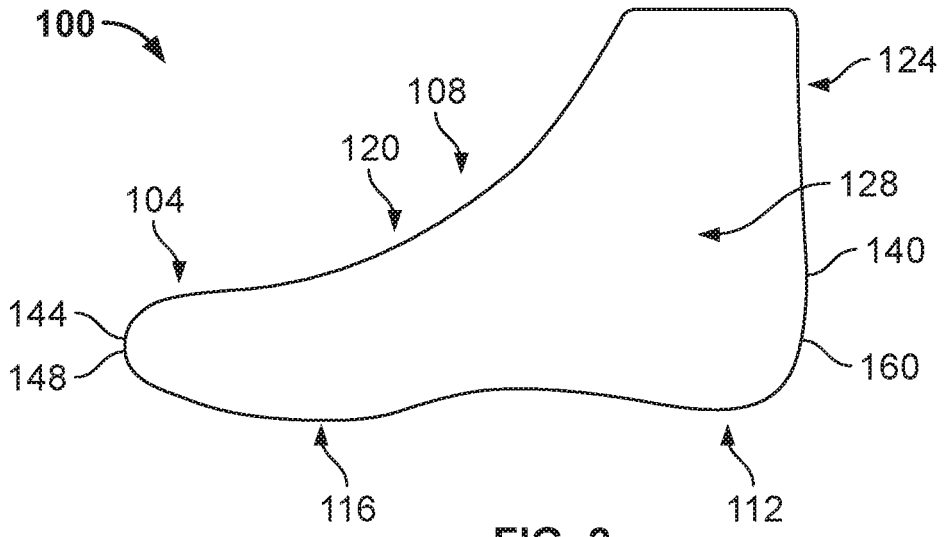
FIG. 2 is a left side elevational view of a last, according to an embodiment of the present disclosure.

FIGS. 2-35 illustrate exemplary embodiments of winding elements provided by the present disclosure. With reference to FIG. 2, generally, winding elements may be fabricated using an underlying support structure or element, such as a shoe last 100. In the present embodiment, the last 100 is sized and shaped to correspond to a foot of a user. That is, the last 100 is generally intended to simulate a foot of a user and, therefore, defines a forefoot region 104, a midfoot region 108, and a heel region 112 that correspond with regions of a human foot. Particularly, the forefoot region 104 generally corresponds with portions of the last 100 that resemble portions of the foot that include the toes, the ball of the foot, and joints connecting the metatarsals with the toes or phalanges. The midfoot region 108 is proximate and adjoining the forefoot region 104, and generally corresponds with portions of the last 100 that correspond with the arch of a foot, along with the bridge of a foot. The heel region 112 is proximate and adjoining the midfoot region 108 and generally corresponds with portions of the last 100 that equate to rear portions of the foot, including the heel or calcaneus bone, the ankle, and/or the Achilles tendon. The last 100 further includes a sole side 116 and an opposing instep side 120 in addition to an ankle region 124. The ankle region 124 is primarily located proximate the heel region 112; however, in some embodiments, the ankle region 124 may partially extend into the midfoot region 108.

Figure 3:
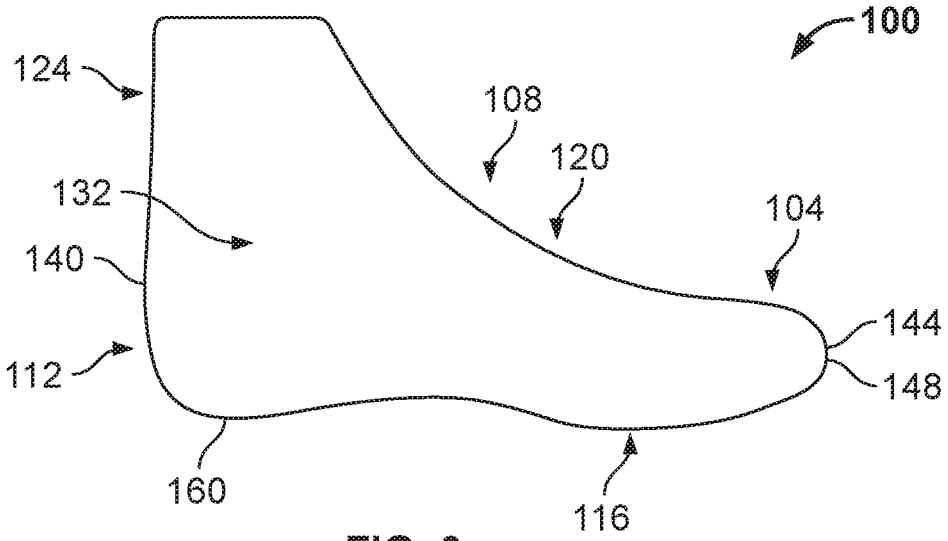
FIG. 3 is a right side elevational view of the last of FIG. 2.

Referring to FIGS. 2 and 3, the last 100 also defines a lateral side 128 and a medial side 132, the lateral side 128 being shown in FIG. 2 and the medial side 132 being shown in FIG. 3. The lateral side 128 corresponds with a region of the last 100 that simulates an outside-facing portion of the foot of a user, while the medial side 132 corresponds with portions of the last 100 that represent an inside-facing portion of the foot. As such, a left foot and a right foot have opposing lateral sides 128 and medial sides 132, such that the medial sides 132 are closest to one another, while the lateral sides 128 are defined as the sides that are farthest from one another on the foot. As will be discussed in greater detail below, the medial side 132 and the lateral side 128 adjoin one another at opposing, distal ends of the last 100.

While only the last 100 is depicted in isolation, i.e., a last configured to create a shoe that is worn on a right foot of a user, the concepts disclosed herein are applicable to a pair of shoes (not shown), which includes a left shoe and a right shoe that may be sized and shaped to receive a left foot and a right foot of a user, respectively. For ease of disclosure, however, a single last and, accordingly, a single shoe will be referenced to describe embodiments of the disclosure, but the disclosure below with reference to the last 100 is applicable to both a left shoe and a right shoe. However, in some embodiments there may be differences between a left shoe and a right shoe other than the left/right configuration. Further, in some embodiments, a left shoe may include one or more additional elements that a right shoe does not include, or vice versa.

Figure 4:
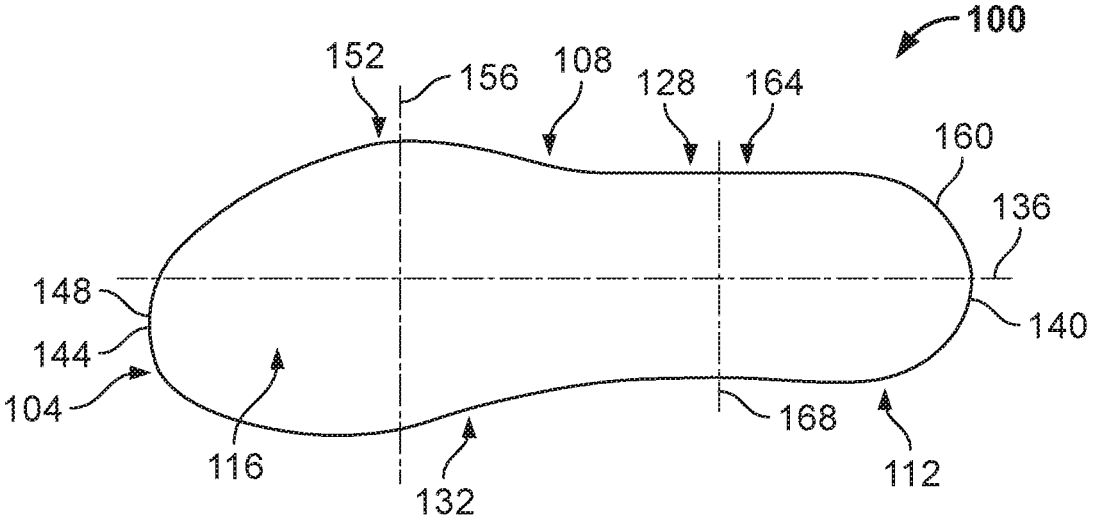
FIG. 4 is a bottom plan view of the last of FIG. 2.

Referring to FIG. 4, the medial side 132 and the lateral side 128 adjoin one another along a longitudinal central plane or axis 136 of the last 100. As will be further discussed herein, the longitudinal central plane or axis 136 may demarcate a central, intermediate axis between the medial side 132 and the lateral side 128 of the last 100. Differently said, the longitudinal plane or axis 136 may extend between a rear, distal end 140 of the last 100 and a front, distal end 144 of the last 100 and may continuously define a middle of the last 100 and/or any components arranged thereon, such as, e.g., an upper, a sole, a winding element, or an article of footwear, i.e., the longitudinal plane or axis 136 is a straight axis extending through the rear, distal end 140 of the heel region 112 to the front, distal end 144 of the forefoot region 104.

Still referring to FIG. 4, the forefoot region 104, the midfoot region 108, the heel region 112, the medial side 132, and the lateral side 128 are intended to define boundaries or areas of the last 100. To that end, the forefoot region 104, the midfoot region 108, the heel region 112, the medial side 132, and the lateral side 128 generally characterize sections of the last 100. Certain aspects of the disclosure may refer to portions or elements that are coextensive with one or more of the forefoot region 104, the midfoot region 108, the heel region 112, the medial side 132, and/or the lateral side 128. Further, components disposed on the last 100, such as a winding element or an article of footwear, may be characterized as having portions within the forefoot region 104, the midfoot region 108, the heel region 112, and/or along the medial side 132 and/or the lateral side 128.

Still referring to FIG. 4, the last 100 extends from a toe end 148 to a widest portion 152 of the last 100. The widest portion 152 is defined or measured along a first line 156 that is perpendicular with respect to the longitudinal axis 136 that extends from a distal portion of the toe end 148 to a distal portion of a heel end 160, which is opposite the toe end 148. The midfoot region 108 extends from the widest portion 152 to a thinnest portion 164 of the last 100. The thinnest portion 164 of the last 100 is defined as the thinnest portion of the last 100 measured across a second line 168 that is perpendicular with respect to the longitudinal axis 136. The heel region 112 extends from the thinnest portion 164 to the heel end 160 of the last 100.

With continued reference to FIG. 4, the medial side 132 begins at the front, distal end 144 and bows outward along the medial side 132 of the last 100 along the forefoot region 104 toward the midfoot region 108. The medial side 132 reaches the first line 156, at which point the medial side 132 bows inwardly, toward the central, longitudinal axis 136. The medial side 132 extends from the first line 156, i.e., the widest portion 152, toward the second line 168, i.e., the thinnest portion 164, at which point the medial side 132 enters into the midfoot region 108, i.e., upon crossing the first line 156. Once reaching the second line 168, the medial side 132 bows outwardly, away from the longitudinal, central axis 136, at which point the medial side 132 extends into the heel region 112, i.e., upon crossing the second line 168. The medial side 132 then bows outward and then inward toward the heel end 160, and terminates at a point where the medial side 132 meets the longitudinal, center axis 136. Similarly, the lateral side 128 also begins at the front, distal end 144 and bows outward along the lateral side 128 of the last 100 along the forefoot region 104 toward the midfoot region 108. The lateral side 128 reaches the first line 156, at which point the lateral side 128 bows inwardly, toward the longitudinal, central axis 136. The lateral side 128 extends from the first line 156, i.e., the widest portion 152, toward the second line 168, i.e., the thinnest portion 164, at which point the lateral side 128 enters into the midfoot region 108, i.e., upon crossing the first line 156. Once reaching the second line 168, the lateral side 128 bows outwardly, away from the longitudinal, central axis 136, at which point the lateral side 128 extends into the heel region 112, i.e., upon crossing the second line 168. The lateral side 128 then bows outward and then inward toward the heel end 160, and terminates at a point where the lateral side 128 meets the longitudinal, center axis 136.

Figure 5:
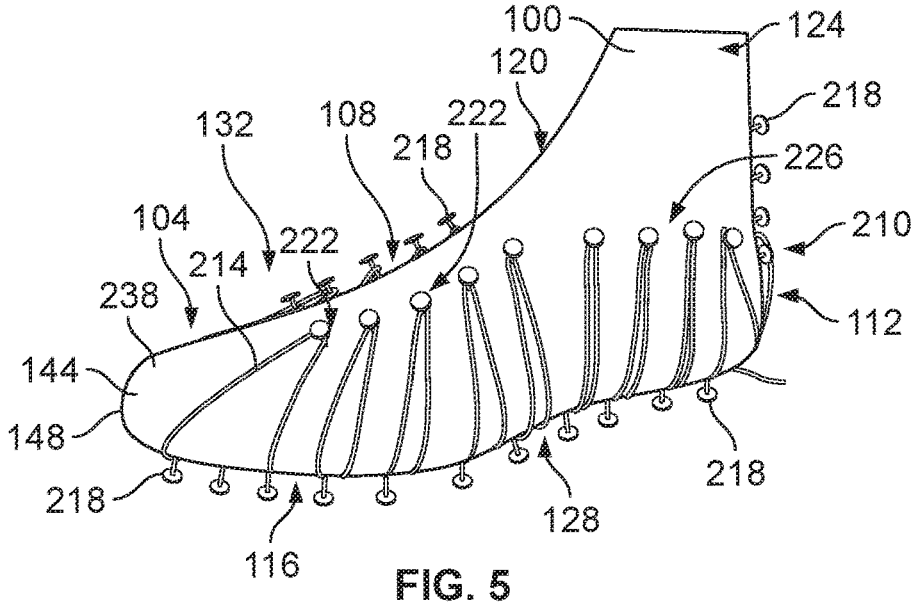
FIG. 5 is left side perspective view of a last and a winding element configured to be incorporated into an article of footwear, according to an embodiment of the present disclosure.
Figure 6:
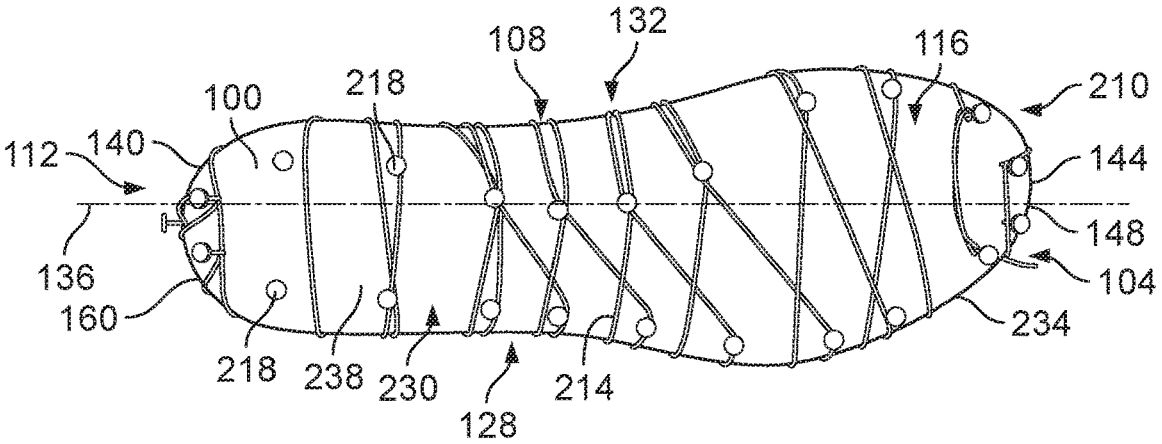
FIG. 6 is a bottom plan view of the last and the winding element of FIG. 5.

FIGS. 5 and 6 illustrate an exemplary embodiment of a winding element 210 for use in an article of footwear. The winding element 210 includes at least one continuous strand 214 that is arranged on and/or around the last 100. More specifically, in the embodiment illustrated, the strand 214 wraps around a plurality of pins 218 or removable pegs that are securely coupled to the last 100. Although the present embodiment includes pins that are attached to the underlying last 100, alternative embodiments may include other means for fastening, such as, e.g., hooks, adhesives, clamps, etc. In some embodiments, the last may include a plurality of predefined holes 222 configured for receiving one or more pins at a variety of predefined installation locations. The pins may thus be selectively installed in one or more of the predefined holes. Alternatively, the last may be configured such that its installation locations for the pins are not predefined. For example, pins may be positioned anywhere on the last by way of a variety of methods, such as hammering or drilling. In some embodiments, the pins may include external threads and may be screwed into the last. Further, in some embodiments, the pins may be secured to the last using adhesive. In the illustrated embodiment, with particular reference to FIG. 5, the pins 218 are arranged on the last 100 so that some of the plurality of the pins 218 extend along a first path 226 that extends from the heel region 112 toward the forefoot region 104 proximate the instep side 120. The first path 226 may be disposed on both the lateral side 128 and the medial side 132 of the last such that the plurality of pins 218 are disposed along substantially symmetrical paths on the lateral side 128 and the medial side 132, the first path 226 being substantially symmetrical about the central, longitudinal axis 136 of the last 100 (see FIG. 6).

Turning to FIG. 6, the plurality of pins 218 may also be disposed on the sole side 116 of the last 100. In the illustrated embodiment, the pins 218 are positioned along a second path 230 that is disposed inwardly from a perimeter 234 of the last 100, which may be defined as the junction between the sole side 116 and both of the lateral side 128 and the medial side 132. More specifically, when viewed normal to the sole side 116 of the last 100, the perimeter 234 may be a periphery of the last 100. Thus, the second path 230 of pins 218 are arranged radially inward from the perimeter 234 of the last 100. The second path 230 may slightly follow a curvature of the perimeter 234 so that it bows inwardly where the last 100 bows inwardly and bows outwardly where the last 100 bows outwardly. In the illustrated embodiment, the second path 230 bows inwardly more than the last 100 adjacent the medial side 132. However, in alternative embodiments, the pins 218 may be arranged along a variety of paths different from the paths illustrated.

Generally, anchors, such as the pins 218, may be provided to enable one or more continuous strands to change direction and to secure one or more strands in a particular position. As shown in FIGS. 5 and 6, at least one continuous strand 214 wraps around each of the pins 218 such that the strand extends between the pins 218 along a surface 238 of the last 100. More specifically, in the embodiment illustrated, the continuous strand 214 generally alternates between the pins 218 of the first path 226 and the pins 218 of the second path 230 so that the strand 214 extends at least partially vertically along the lateral side 128 or medial side 132 of the last 100. The continuous strand 214 may comprise a single continuous strand or one or more continuous strands comprising the same material or different materials.

Figure 7:
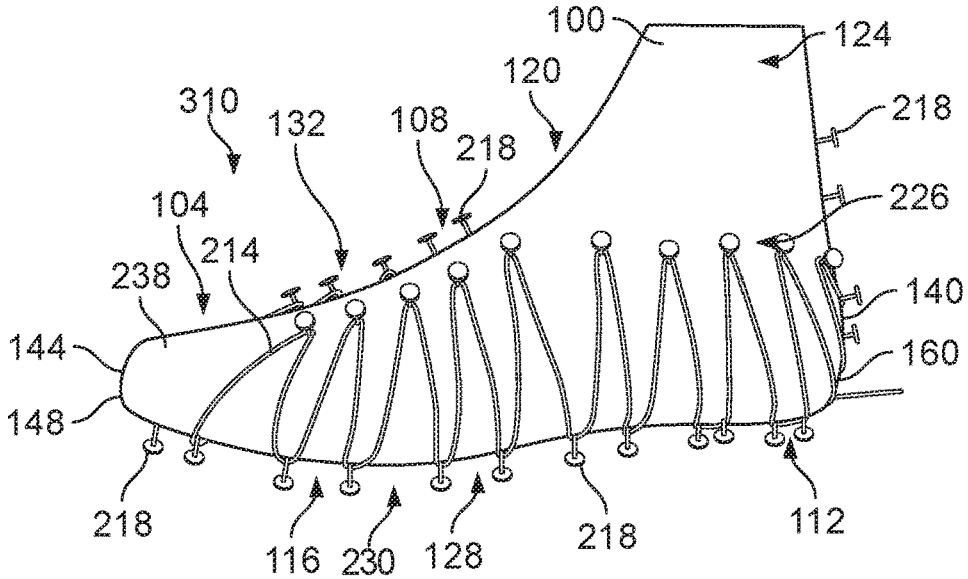
FIG. 7 is a left side perspective view of a last and a winding element configured to be incorporated into an article of footwear, according to another embodiment of the present disclosure.
Figure 8:
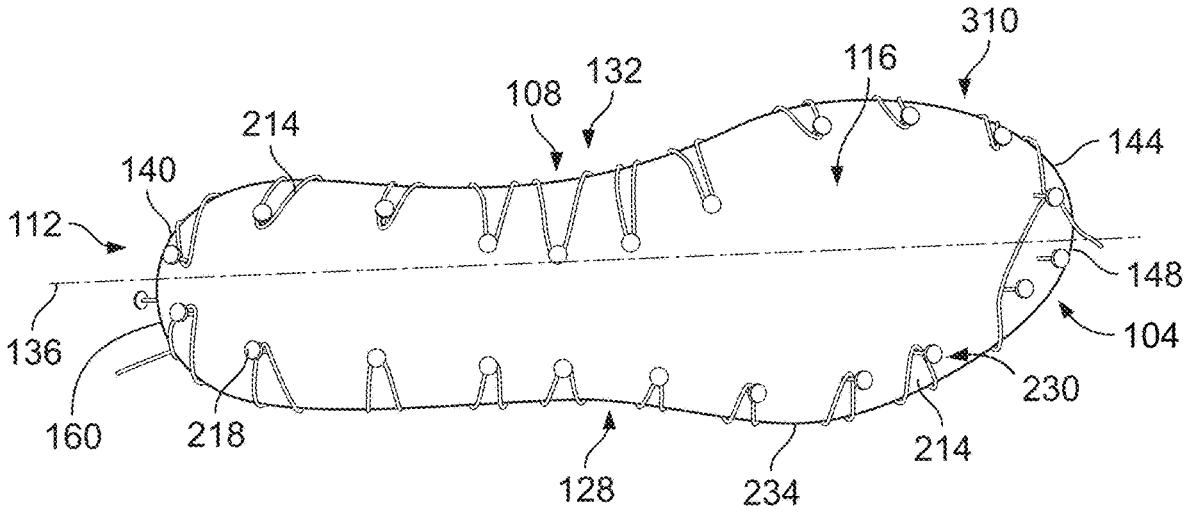
FIG. 8 is a bottom plan view of the last and the winding element of FIG. 7.

Referring to FIG. 6, in the illustrated embodiment, the continuous strand 214 is configured to extend between the lateral side 128 and medial side 132 of the last 100 to at least partially contact and cover the sole side 116 of the last 100. As illustrated, the pins 218 disposed along the second path 230 are used to direct the strand 214 as it travels between the lateral side 128 and the medial side 132. For example, in some instances, it may be preferred to increase strand interaction. Therefore, the pins 218 may be used to enhance and/or control the strand interaction by being positioned so that the strands interact, i.e., overlap or intersect, in particular areas, which may result in enhanced strength or stiffness. Contrarily, in some instances, it may be preferred to have minimal interaction between strands, so the pins 218 may be used to reduce, minimize, or eliminate strand overlap, thereby increasing flexibility of the resulting winding element 210. For example, FIGS. 7 and 8 illustrate another embodiment of a winding element 310 for an article of footwear, which is created using the last 100, the pins 218, and the continuous strand 214 as described above; however, the strand 214 is wrapped in a way as to reduce or minimize strand interaction. More specifically, referring particularly to FIG. 7, the strand 214 alternates between the pins 218 disposed along the first path 226 and the pins 218 disposed along the second path 230 so that the strand 214 does not cross from the lateral side 128 to the medial side 132 along the sole side 116 of the last 100, which is best illustrated in FIG. 8. Referring again to FIG. 7, the strand 214 alternates between the pins 218 to define a zig-zag pattern. In this way, the strand 214 substantially avoids overlapping itself.

FIGS. 5 and 6 and FIGS. 7 and 8 illustrate just two embodiments of winding elements that may be produced using methods of the present disclosure. It should be apparent, however, that the winding elements 210, 310 shown in FIGS. 5 and 6 and FIGS. 7-10, respectively, may exist in combination with other winding elements according to embodiments of the present disclosure. For example, in one embodiment, the winding element 210 of FIG. 5 may be overlapped by the winding element 310 of FIG. 7. Similarly, in one embodiment, the winding element 310 of FIG. 7 may be overlapped by the winding element 210 of FIG. 5. Furthermore, in some embodiments, the winding elements 210, 310 of FIGS. 5 and 7, respectively, may include additional strands wrapped similarly to or differently than the continuous strand 214.

Figure 9:
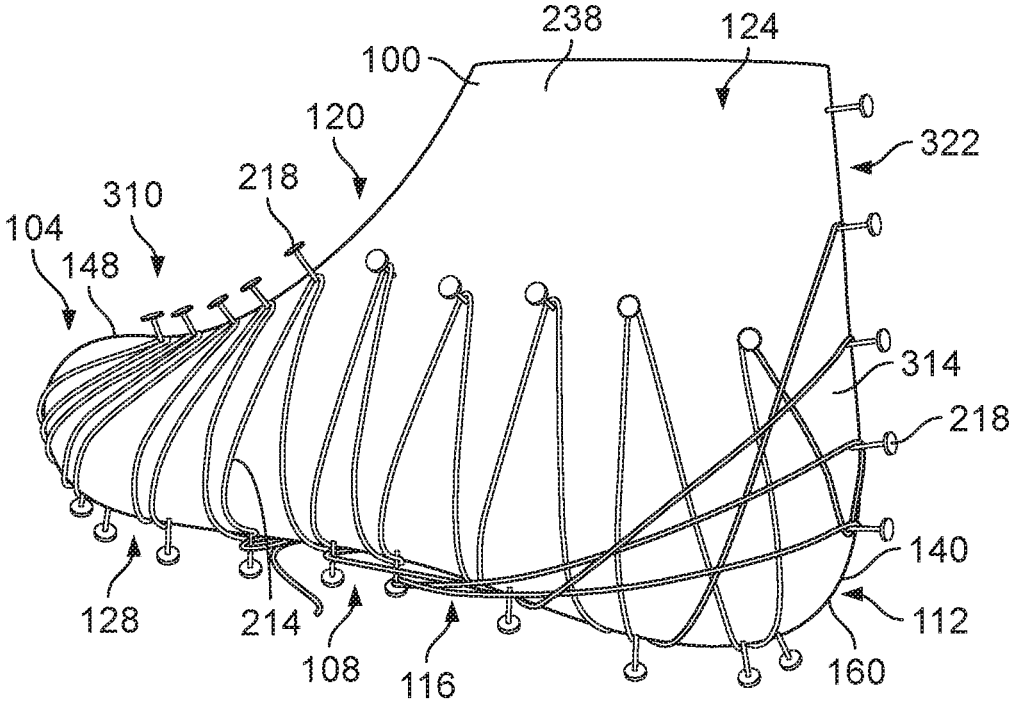
FIG. 9 is a left side perspective view of a last and a winding element configured to be incorporated into an article of footwear, according to another embodiment of the present disclosure.
Figure 10:
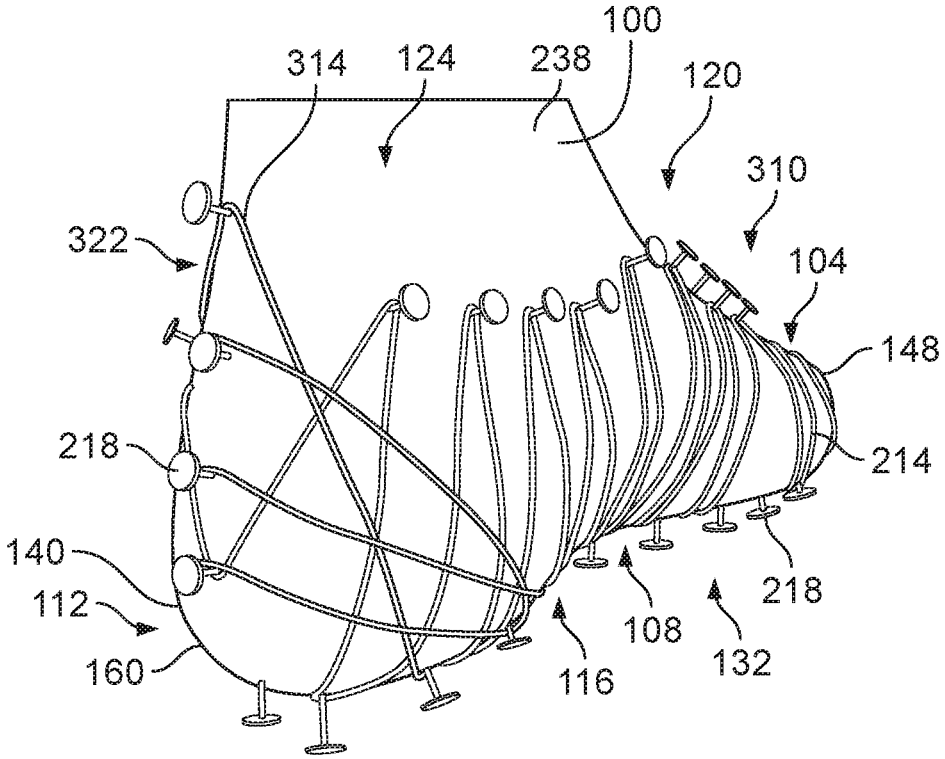
FIG. 10 is a right side perspective view of the last and the winding element of FIG. 9.

FIGS. 9 and 10 illustrate another embodiment of the present disclosure that includes the winding element 310 of FIG. 7 with a second continuous strand 314. That is, in the illustrated embodiment, the continuous strand 214 is a first continuous strand, and the winding element 310 further includes the second continuous strand 314. The second strand 314 is disposed predominately in the heel region 112 of the last 100; however, alternative embodiments may include one or more second strands at a variety of locations. For example, a second continuous strand may be disposed in the midfoot region 108. Further, a secondary strand may be disposed in the forefoot region 104. In the embodiment illustrated, the second continuous strand 314 is wound around pins 218 disposed along the heel region 112 of the last 100, particularly around a plurality of the pins 218 that are disposed along a third path 322 extending away from proximate the sole side 116 toward the ankle region 124 or an Achilles' tendon region of the last 100. The second continuous strand 314 thus extends between the pins 218 along the second path 230 and the pins 218 along the third path 322 as it travels from between the lateral side 128 and the medial side 132. In the illustrated embodiment, the second continuous strand 314 is arranged such that portions of the second continuous strand 314 wrapped around pins 218 on the second path 230 proximate the heel end 160 extend to pins 218 on the third path 322 distal the sole side 116, and portions of the second continuous strand 314 wrapped around pins 218 on the second path 230 proximate the midfoot region 108 extend to pins 218 on the third path 322 proximate the sole side 116. Therefore, the second continuous strand 314 overlaps itself in addition to overlapping the first continuous strand 214. Consequently, when cured or stabilized, the second continuous strand 314 may provide enhanced stability, strength, and/or protection in the heel region 112 of the winding element 310.

In some embodiments, the strands, e.g., the first continuous strand 214 and the second continuous strand 314, may be any combination of filaments, fibers, yarns, knitted elements, cables, cords, fiber tows, tapes, ribbons, monofilaments, braids, strings, or the like. Further, the strand may be composed at least in part of any combination of a variety of materials, such as, e.g., thermoplastic polyurethane (TPU), rubber, silicone, polyester, nylon, ultra-high molecular weight polyethylene, carbon fiber, KEVLAR®, a bioengineered woven material, a knit material, layered materials (e.g., synthetic spider silk), woven materials, layered plant based materials, knit or layered recycled and/or extruded plastics, cotton, wool, carbon fiber, and natural or artificial silk. In some embodiments, the strands may be composed of a single material. In some embodiments, the strands may be composed of different materials. For example, the first continuous strand 214 may be a polyester strand, and the second continuous strand 314 may comprise a polymer sheath with a carbon fiber core. Further, the first continuous strand may have a stretch resistance that is less than 50% or 80% of a stretch resistance of the second continuous strand. Additionally or alternatively, the first continuous strand may have a thickness that is less than 50% or 75% of a thickness of the second continuous strand.

While the winding element 310 shown in FIGS. 9 and 10 may be incorporated into an article of footwear as is, additional strands may be added. For example, with reference to FIGS. 11 and 12, a third continuous strand 326 and a fourth continuous strand 330 are used in addition to the first continuous strand 214 and the second continuous strand 314. Similar to the discussion above with regard to the second continuous strand 314, the third continuous strand 326 and the fourth continuous strand 330 may comprise the same material as the first continuous strand 214 and/or the second continuous strand 314. In some embodiments, however, the third continuous strand 326 and the fourth continuous strand 330 may be composed of different materials. For example, the first and second continuous strands 214, 314 may comprise natural materials, such as cotton or wool, and the third and fourth continuous strands 326, 330 may comprise a thermoplastic polymer.

Figure 11:
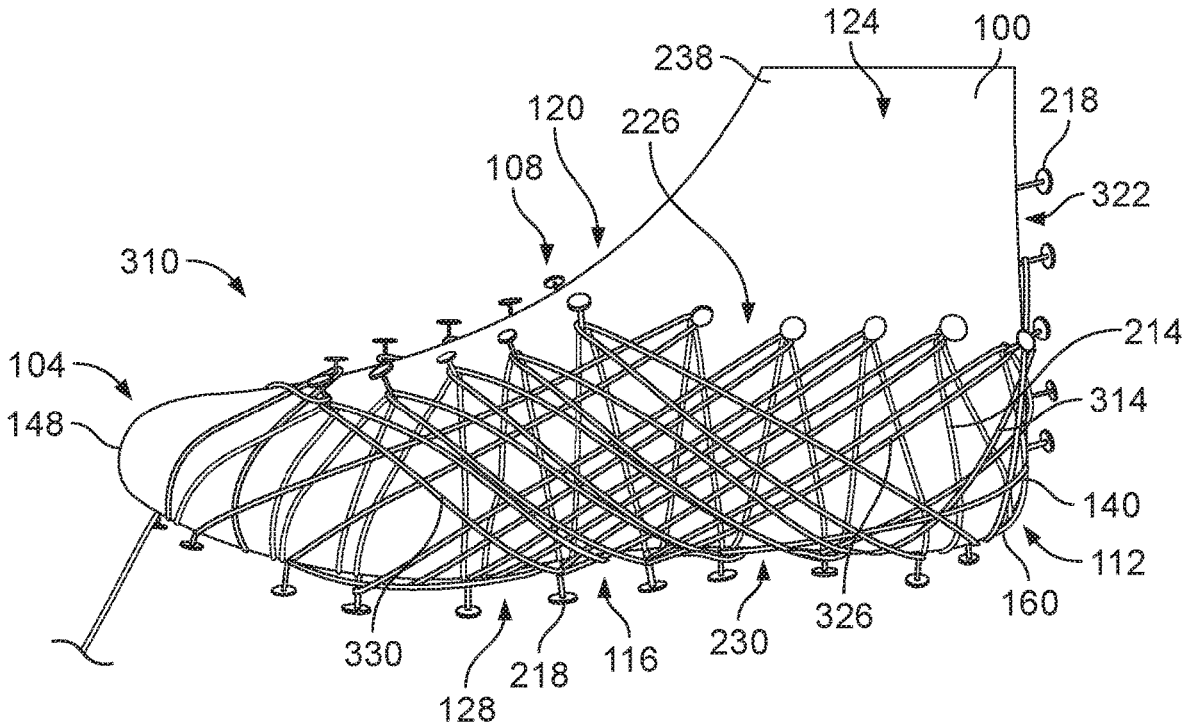
FIG. 11 is a left side elevational view of a last and a winding element configured to be incorporated into an article of footwear, according to another embodiment of the present disclosure.
Figure 12:
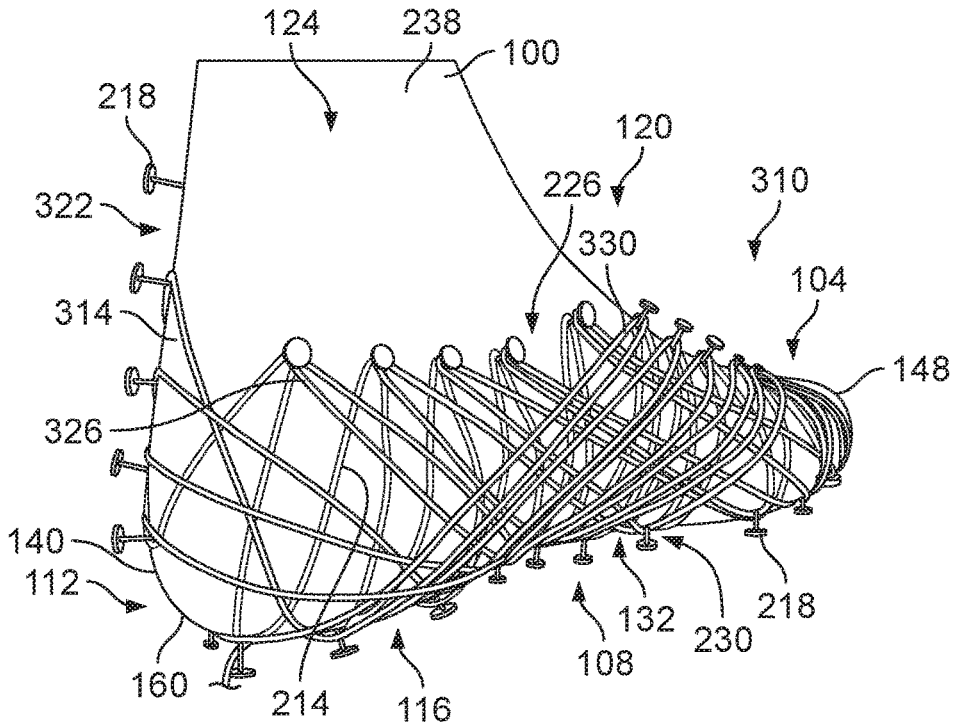
FIG. 12 is a right side perspective view of the last and the winding element of FIG. 11.

In the embodiment illustrated, still referring to FIGS. 11 and 12, the third continuous thread 326 is disposed on both the lateral and medial sides 128, 132 of the last 100 and is arranged in a first direction that substantially extends between the toe end 148 proximate the sole side 116 toward the heel region 112 proximate the ankle region 124. The fourth continuous thread 330 is similarly disposed on both the lateral and medial sides 128, 132 and may be arranged in a second direction that complements the third continuous thread 326. For example, the fourth continuous thread 330 may extend from the heel region 112 proximate the sole side 116 toward the toe end 148 proximate the instep side 120. Consequently, the third continuous thread 326 and the fourth continuous thread 330 may generally extend in opposing directions.

Figure 14:
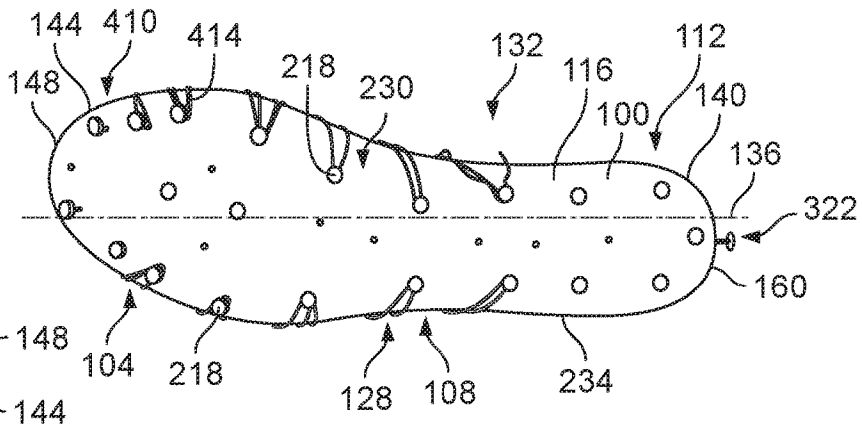
FIG. 14 is a bottom plan view of the last and the winding element of FIG. 13.
Figure 13:
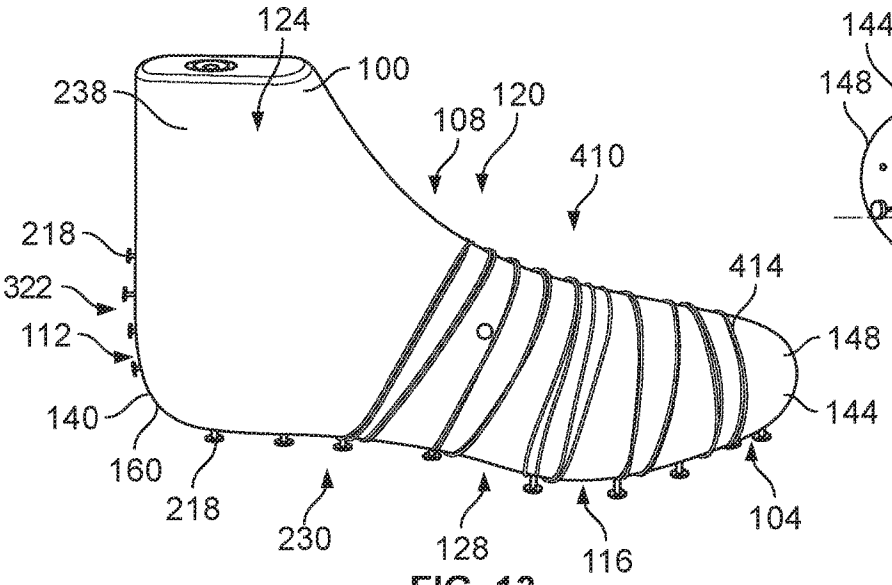
FIG. 13 is a right side elevational view of a last and a winding element configured to be incorporated into an article of footwear, according to another embodiment of the present disclosure.

FIGS. 13-19 illustrate a winding element 410 according to another embodiment of the present disclosure. Particularly, FIGS. 13-19 illustrate steps for creating the winding element 410, which is shown in completion in FIG. 19. Referring particularly to FIG. 14, to form the winding element 410, the last 100 includes pins 218 disposed on the sole side 116 and at the heel end 160 of the last 100. The pins 218 may extend along the second path 230 and the third path 322 as introduced above with regard to FIG. 9. As shown in FIG. 13, the winding element 410 may include a first continuous strand 414 that is disposed substantially in the midfoot region 108 and the forefoot region 104 of the last 100. Contrary to the winding element 310 shown in FIG. 9, the first continuous strand 414 is arranged to extend laterally across the instep side 120 of the last 100, extending between and covering both the lateral side 128 and the medial side 132. More specifically, the first continuous strand 414 extends from one of the pins 218 on the lateral side 128 to one of the pins 218 on the medial side 132 to create a plurality of strand extensions covering the instep side 120. The first strand 414 may wrap around the last 100 for at least 180 degrees about the longitudinal axis 136 (see FIG. 14). In some embodiments, the first strand 414 may extend along at least 200, 150, 270, or 300 degrees of the last 100 about the longitudinal axis 136 (see FIG. 14). In the illustrated embodiment, each of the plurality of individual extensions of the first strand 414 are arranged to avoid strand interaction. That is, the plurality of individual extensions substantially do not cross or contact each other. Furthermore, as shown in FIG. 14, the first continuous strand 414 changes direction at each pin 218 and, thus, does not cross the sole side 116 of the last 100. Differently said, the first continuous strand 414 extends from the lateral side 128 in a first direction to one of the pins 218 on the medial side 132, wraps around the pin 218, and extends in a second, reverse direction to return to the lateral side 128. The first continuous strand 414 may further wrap around one of the pins 216 on the lateral side 128 so that it may extend toward the medial side 132 again. The first continuous strand 414 may continue alternating between the lateral side 128 and the medial side 132 until it substantially covers a length of the last 100.

Figure 16:
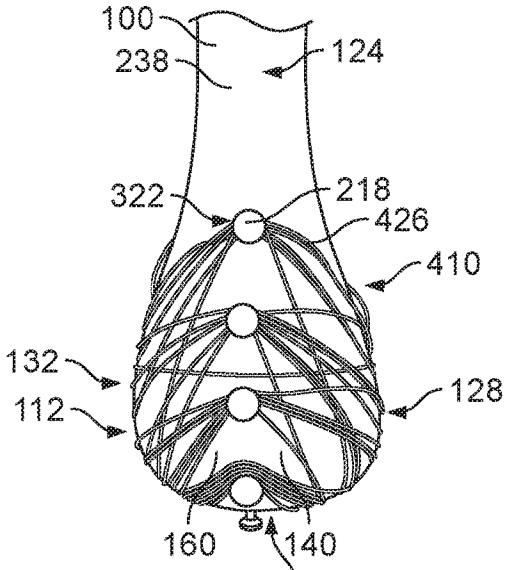
FIG. 16 is a rear elevational view the last and the winding element of FIG. 15.
Figure 15:
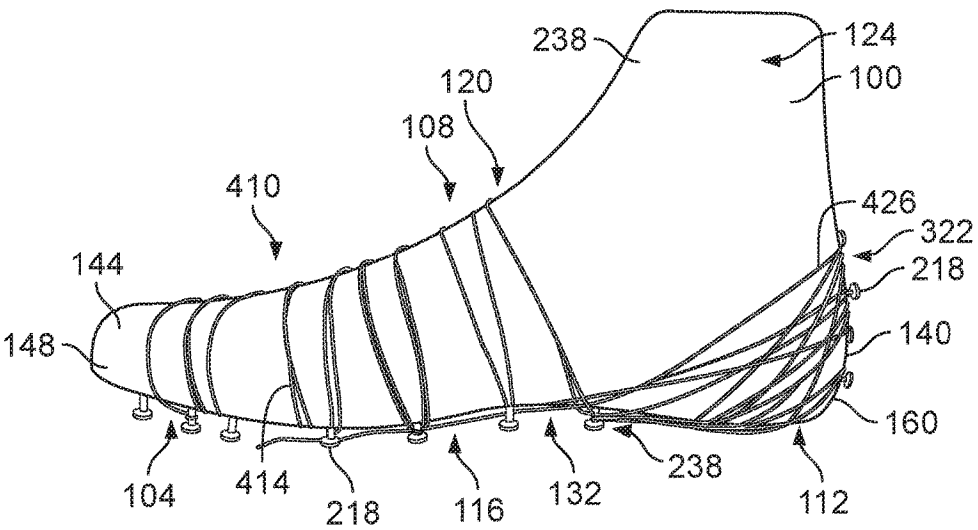
FIG. 15 is a left side elevational view of a last and a winding element configured to be incorporated into an article of footwear, according to another embodiment of the present disclosure.

Turning to FIG. 15, in addition to the first continuous thread 414, a second continuous strand 426 may be incorporated into the winding element 410. As best seen in FIG. 16, the second continuous strand 426 may be arranged on the heel region 112 of the last 100 and extend from the lateral side 128 to the medial side 132 so that the strand 426 crosses and extends along the heel end 160 of the last 100. The pins 218 disposed on the heel end 160 are disposed along the third path 322, which is a substantially linear path that extends from proximate the heel end 160 toward the ankle region 124. These pins 218 may be used to guide, contain, or otherwise support the second continuous strand 426 as it extends between the lateral side 128 and medial side 132.

Figure 17:
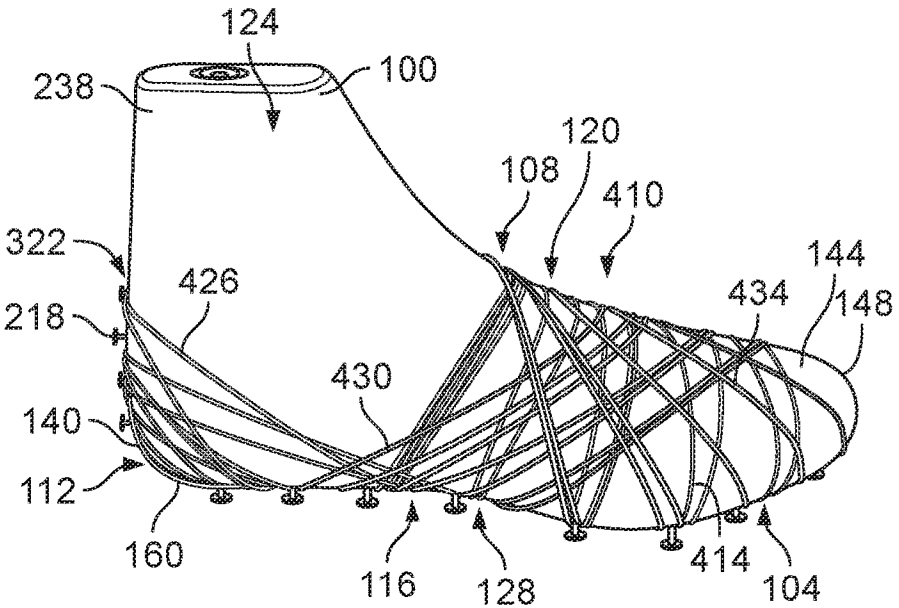
FIG. 17 is a right side elevational view of a last and a winding element configured to be incorporated into an article of footwear, according to another embodiment of the present disclosure.
Figure 18:
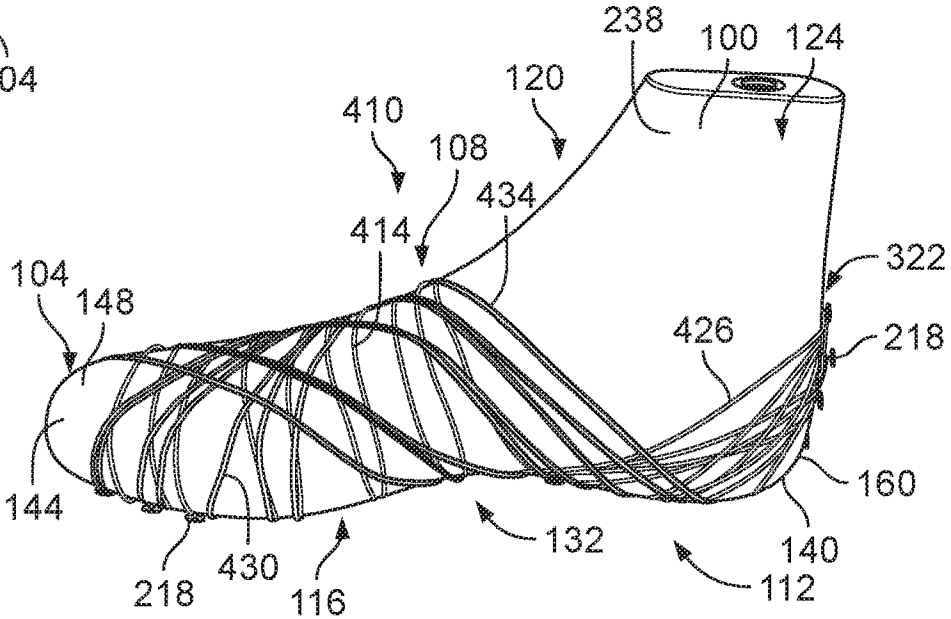
FIG. 18 is a left side elevational view the last and the winding element of FIG. 17.
Figure 19:
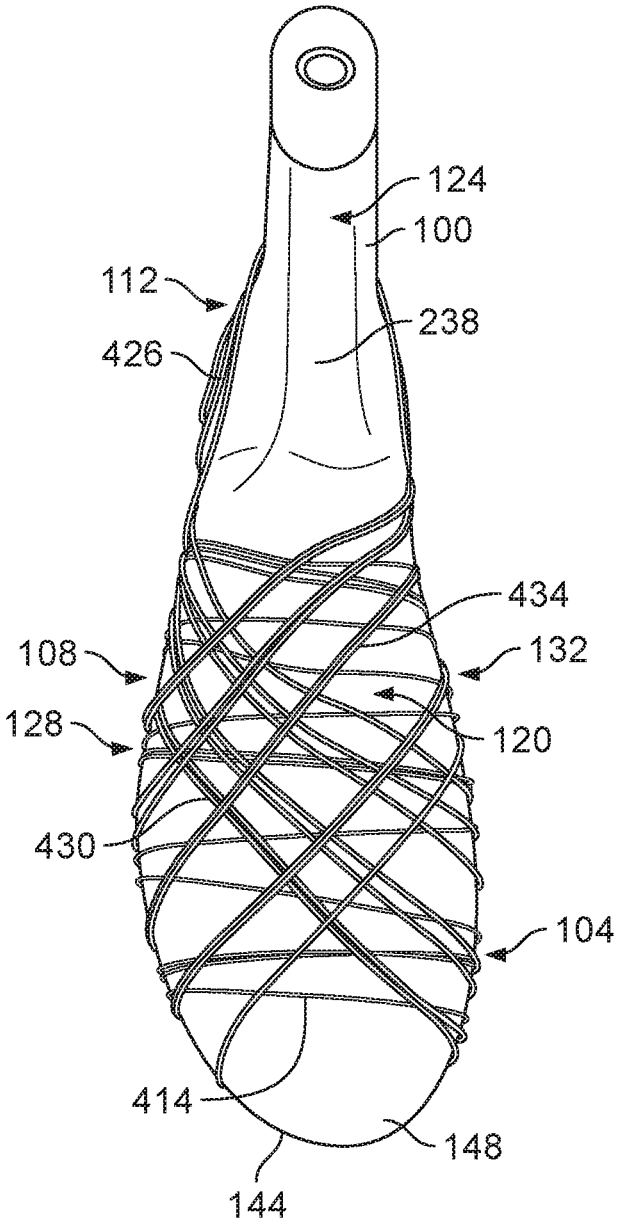
FIG. 19 is a top perspective view of the last and the winding element of FIG. 17.

In some embodiments, the winding element 410 as shown in any of FIGS. 13-16 may be cured or stabilized and incorporated into an article of footwear. However, FIGS. 17-19 show additional elements that may be incorporated into the winding element 410, for example. Referring particularly to FIG. 17, the winding element 410 is shown with a third continuous strand 430 and a fourth continuous strand 434 that extend over the instep side 120 of the last 100 at opposing angles. Particularly, as best shown by FIG. 19, the third continuous strand 430 extends from the lateral side 128 to the medial side 132 in angled relation with the first continuous strand 414, extending from proximate the heel region 112 on the lateral side 128 toward the toe end 148 on the medial side 132. The fourth continuous strand 434 similarly extends in angled relation with the first continuous strand 414 such that it extends from proximate the heel region 112 on the medial side 132 toward proximate the toe end 148 on the lateral side 128. Thus, the third continuous strand 430 and the fourth continuous strand 434 extend substantially perpendicularly to each other.

The configurations of the first, second, third, and fourth continuous strands 414, 426, 430, 434 shown in FIGS. 17-19 are just one example of a plurality of configurations the strands may be define. Further, while the strands 414, 426, 430, 434 according to the illustrated embodiment are discussed as discrete continuous strands, two or more of these strands may comprise a single, continuous strand. That is, the first, second, third, and fourth continuous strands may be formed of the same continuous strand. Alternatively, one or more of the first, second, third, and fourth continuous strands may comprise a plurality of discrete strands. For example, the first continuous strand 414 may include one or more discrete continuous strands. Furthermore, in some embodiments, each of the continuous strands may be formed of a uniform material, such as, e.g., thermoplastic polyurethane (TPU), polyester, nylon, ultra-high molecular weight polyethylene, carbon fiber, cotton, or wool. In some embodiments, one or more of the continuous strands may use different materials. For example, with reference to the embodiment illustrated in FIG. 19, the first continuous strand 414 may be composed of cotton, whereas the second continuous strand 426 includes wool. In one embodiment, the first and second continuous strands may comprise wool to provide moisture wicking capabilities to an interior of an article of footwear, and the third and fourth strands 430, 434 may comprise nylon or polyester to provide abrasion resistance to the article of footwear.

Figure 20:
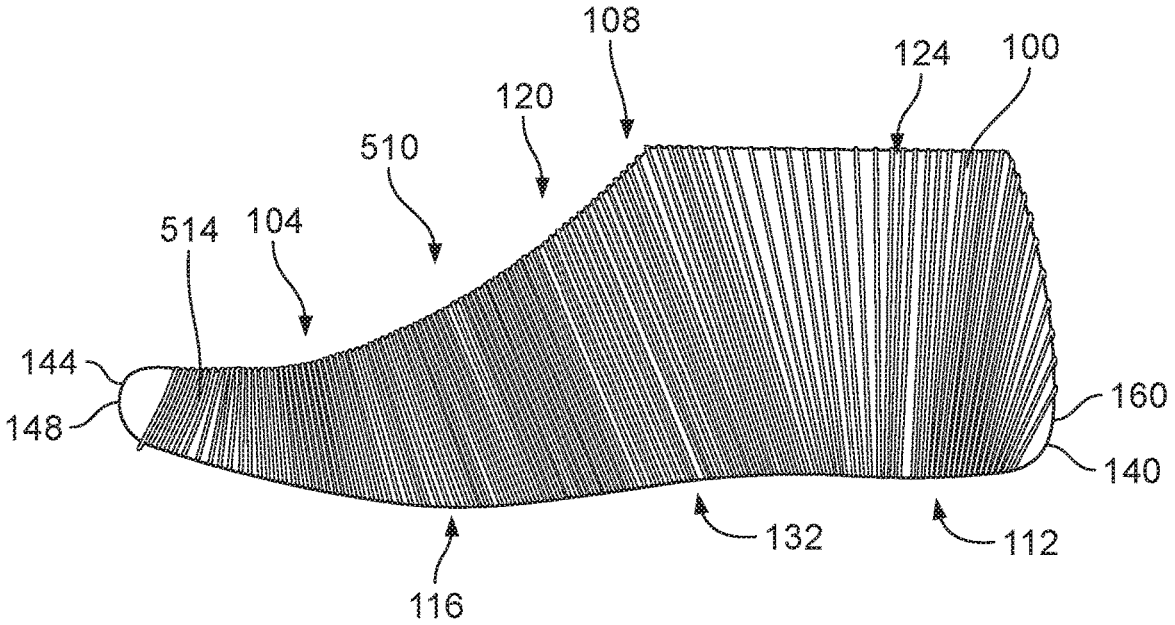
FIG. 20 is a left side elevational view of a last and a winding element configured to be incorporated into an article of footwear, according to another embodiment of the present disclosure.
Figure 21:
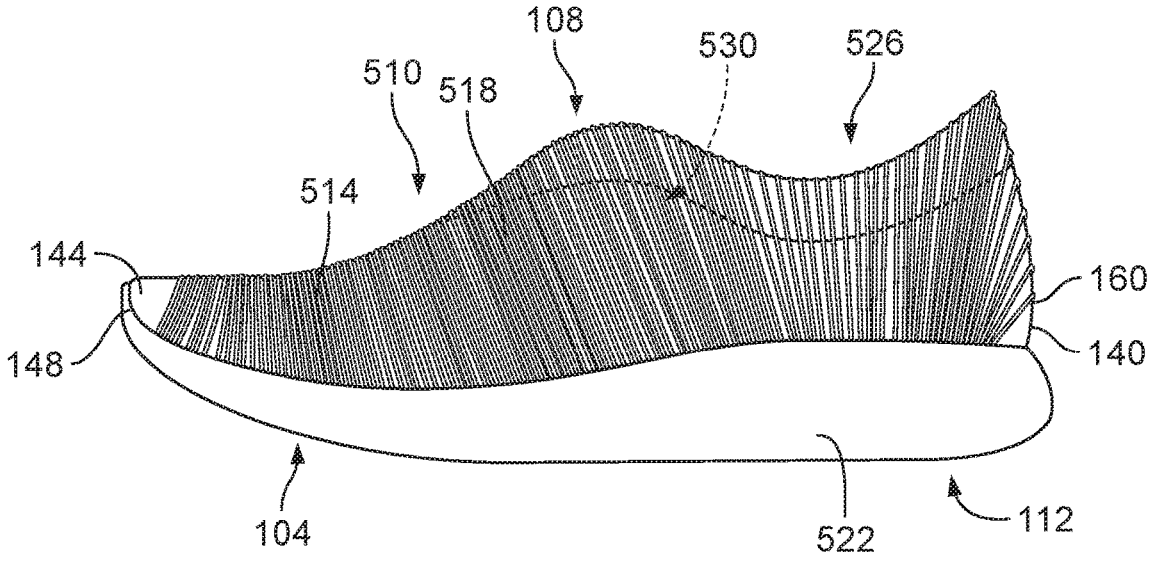
FIG. 21 is a left side elevational view of the winding element of FIG. 20 incorporated into an article of footwear.

FIGS. 20 and 21 provide another example of an article of footwear 506 that includes a winding element 510 according to an embodiment of the present disclosure. In the illustrated embodiment, the winding element 510 is formed on the last 100, similar to the winding element 410 of FIG. 17; however, the winding element 510 is formed without pins or anchor points. More specifically, a single continuous strand 514 is continuously wound around the last 100, beginning at one of the front, distal end 144 or the rear, distal end 140, and ending at the opposing end. The strand 514 may be wound such that it substantially covers the outer surface 238 of the last 100. Accordingly, when cured, the winding element 510 may define a continuous surface of material that is configured to be used as an upper 518 in the article of footwear. Referring to FIG. 21, once cured, the winding element 510 may be modified before being coupled to a sole structure 522. For example, in the embodiment illustrated, the winding element 510 is trimmed along the ankle region 124 to define an opening 526 to an internal cavity 530 configured for receiving a foot therein. Because the strand 514 is cured, material fraying may be substantially avoided.

Figure 22:
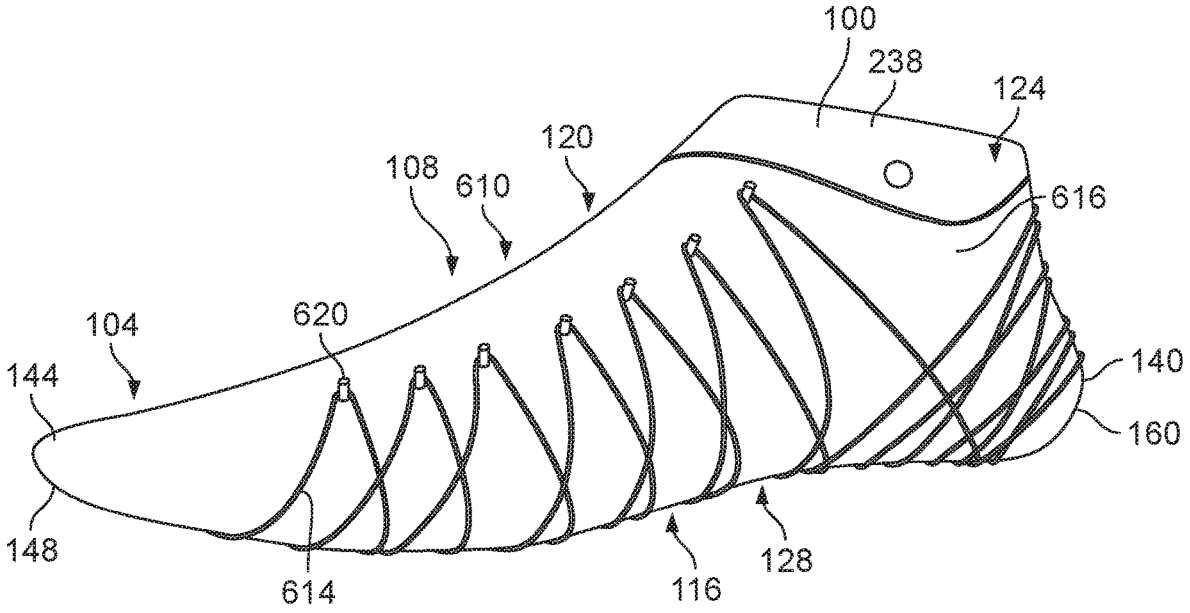
FIG. 22 is a left side perspective view of a last and a winding element configured to be incorporated into an article of footwear, according to another embodiment of the present disclosure.

As discussed above, in some embodiments, the present disclosure may provide a winding element that includes one or more continuous strands that are formed on a base material, such as a fabric layer or a reinforcement layer disposed on a last. Generally, any of the aforementioned examples shown in FIGS. 5-21 may be fabricated on a last with one or more base layers, such as one or more layers of textile material. FIG. 22 illustrates an example of a winding element 610 configured for use as an upper in an article of footwear. Similar to the winding element 210 of FIG. 5, the winding element 610 according to the illustrated embodiment comprises one or more continuous strands 614 wound around the last 100; however, the winding element 610 in the illustrated embodiment further includes a base, reinforcement layer 616 that is disposed on the last 100 and configured to bond to continuous strands 614. The base layer 616 could be formed conventionally from one or more elements, e.g., textiles, polymer foam, polymer sheets, leather, or synthetic leather, which are joined through bonding or stitching at a seam. In some embodiments, the base layer is formed from a knitted structure or knitted components. In various embodiments, a knitted component may incorporate various types of yarn that may provide different properties to an upper. For example, an upper mesh layer may be warp knit, while a mesh backing layer may comprise a circular knit. Further, the base layer may include multiple knit constructions to provide different performance characteristics, such as breathability, strength, support, warmth, protection, etc., to different regions of an upper. For example, a base layer may include a knit construction comprising a higher denier yarn along lateral and medial sides of the last for enhanced support and a knit construction having a lower denier yarn along an instep of the last for enhanced breathability.

Still referring to FIG. 22, a plurality of pins 620, i.e., anchor points, are provided on the last 100 such that they extend through the base layer 616. The one or more continuous strands 614 thus may access the plurality of pins 620 so that they may wind around the pins 620 and, accordingly, the last 100 and the base layer 616. While the winding element 610 according to the illustrated embodiment includes the one or more continuous strands 614 wound in a zig-zag, alternating pattern as illustrated in FIG. 22, the one or more continuous strands 614 may be wound in a variety of patterns. Further, in some embodiments, the winding element 610, which includes the base layer 616 and the one or more continuous strands 614, may be cured or bonded after the winding process is complete. However, in some embodiments, the winding element may be cured or bonded during the winding process. For example, instead of using the plurality of pins 620, a portion of the one or more continuous strand 614 may be bonded to the base layer 616, thereby securing the one or more continuous strand 614 so that it may be wound in a different direction. Differently said, one or more continuous threads may be wound in a first direction before being securing to the base layer along a portion thereof. Once secured, the one or more continuous threads may be wound in a different, second direction while still retaining its positioning along the first direction.

Each of the aforementioned embodiments uses a single last, such as the last 100 shown in FIGS. 2-4, to create winding elements for use in an article of footwear. Generally, the last is a single component comprising a unitary body. However, in some embodiments, the last may comprise one or more components. Further, in some embodiments, additional components may be used with a last to fabricate a winding element. For example, FIGS. 23-25*a* illustrate a last assembly 670 that may be used to create a winding element for an article of footwear. In the present embodiment, the last assembly 670 includes a last 100 and a plate 674, which may also be referred to as a frame or support structure. The plate 674 may be a metal, wooden, carbon fiber, or plastic plate that includes a plurality of anchor points, e.g., pins 686, disposed thereon. Particularly, the pins 686 are arranged along a periphery of the plate 674 such that they extend along and radially outwardly from a perimeter 690 thereof. In the illustrated embodiment, the pins 686 are only disposed on the plate, and the last 100 includes no pins 686; however, in some embodiments, the last may include one or more pins. Further, in some embodiments, the last may include pins while the plate lacks pins.

Figure 23:
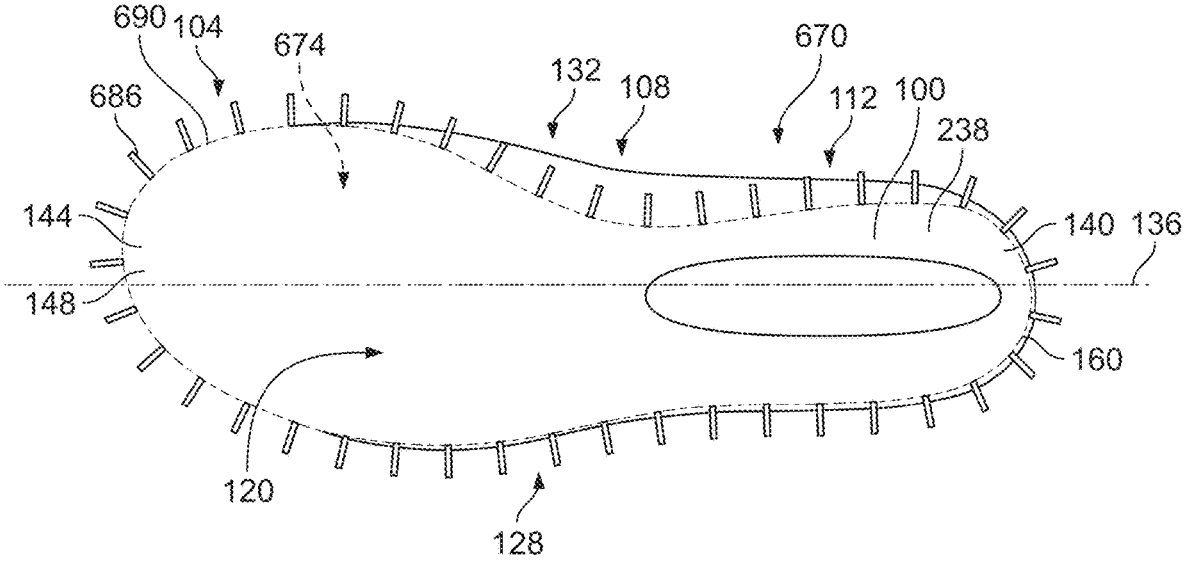
FIG. 23 is a top plan view of a last assembly according to another embodiment of the present disclosure.
Figure 24:
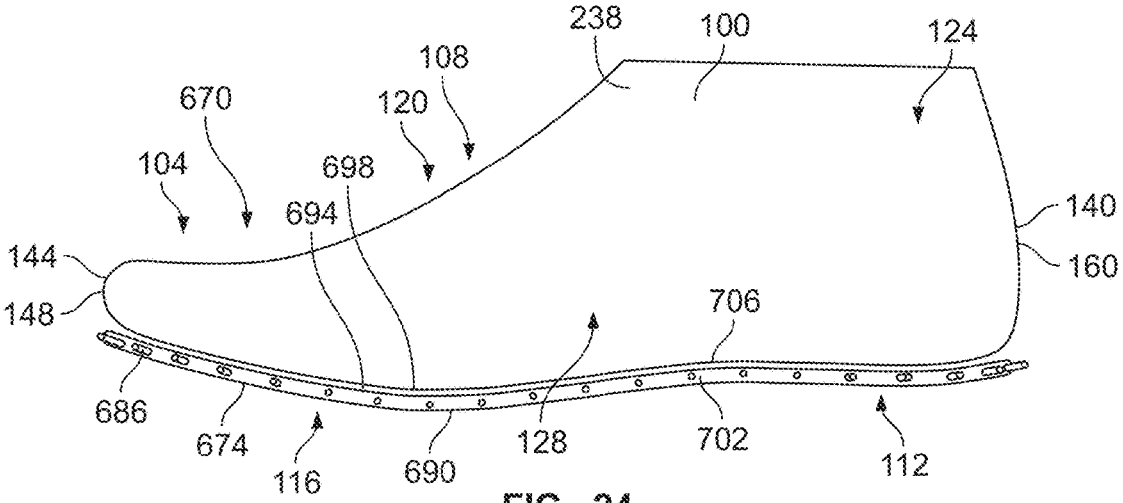
FIG. 24 is a left side elevational view of the last assembly of FIG. 23.

As best seen in FIG. 23, the plate 674 is shaped such that it generally matches a shape of a periphery of the sole side 116 of the last 100. For example, the plate 674 bows inwardly and outwardly to imitate the last 100. Further, as best seen in FIG. 24, the plate 674 generally curves to mimic the curvature of the sole side 116 of the last 100. Particularly, the plate 674 includes a concave portion 694, which is configured to fit with a convex portion 698 of the last 100, and the plate 674 further includes a convex portion 702 configured to complement a concave portion 706 of the last. The plate 674 thus may be arranged adjacent the sole side 116 of the last 100. In some embodiments, the plate 674 may be fixedly secured to the last 100 by way of fasteners known in the art, such as, e.g., nails, screws, adhesives, or the like. Alternatively, the plate may be removably attached to the sole side 116 of the last 100, e.g., by using hook and loop fasteners, magnets, latches, or the like.

Figure 25A:
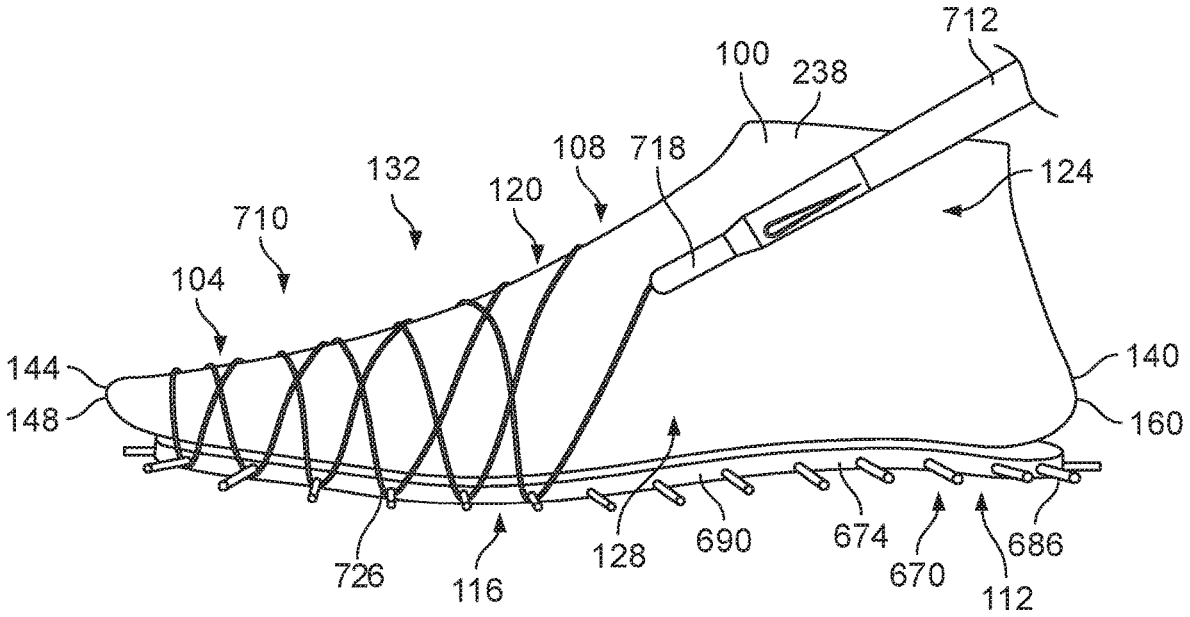
FIG. 25*a* is a left side elevational view of the last assembly of FIG. 23 with a winding element being formed thereon that is configured to be incorporated into an article of footwear, according to another embodiment of the present disclosure.

FIG. 25*a* illustrates a winding element 710 being fabricated on the last assembly 670. A strand supply system 714, which includes an arm 718 that is configured to dispense a continuous strand, is configured to wind a first continuous strand 722 around the last 100 and the plate 674. The arm 718 may move the strand 722 between the pins 686 adjacent the lateral side 128 of the last 100 and the pins 686 adjacent the medial side 132 of the last 100, the strand 722 being wound around the instep side 120 of the last 100. Thus, the strand 722 may alternate between wrapping around one of the plurality of pins 686 on the plate 674 and extending along the surface 238 of the last 100. The strand 722 extends along the outer surface of the last 100 and substantially forms to the last 100. In the embodiment illustrated, the arm 718 is movable relative to the last 100 and the plate 674 so that the last 100 and the plate 674 remain substantially stationary while the arm 718 moves to dispense the continuous strand 722. However, in some embodiments, the last and the plate may move in unison relative to a stationary arm. Further, in some embodiments, each of the last, the plate, and the arm may be movable. As shown in FIG. 25*a*, the continuous strand 722 is dispensed to crisscross along a surface of the last 100; however, it should be understood that embodiments of the present disclosure may comprise winding elements with a variety of strand patterns and are not limited to the patterns illustrated herein. The winding element 710 may be cured during or after the winding process, and the winding element 710 may be subsequently removed from the last 100 and the plate 674. In some instances, the pins 686 may be ejected or retracted from the perimeter 690 of the plate 674 to facilitate removal of the winding element 710. Additionally or alternatively, the winding element 710 may be trimmed along a boundary 726 thereof in order to release the winding element 710 from the plate 674.

Furthermore, aspects of the present disclosure may be particularly useful for fabricating an article of footwear having a plurality of components in a simplified process. For example, still referring to FIG. 25*a*, the winding element 710 may remain on the last 100 while a sole structure is disposed adjacent the plate 674, and the winding element 710 may be subsequently attached to the sole structure. The plate 674 may be arranged between the winding element 710 and a midsole of a sole structure to facilitate assembly of an article of footwear.

Figure 25B:
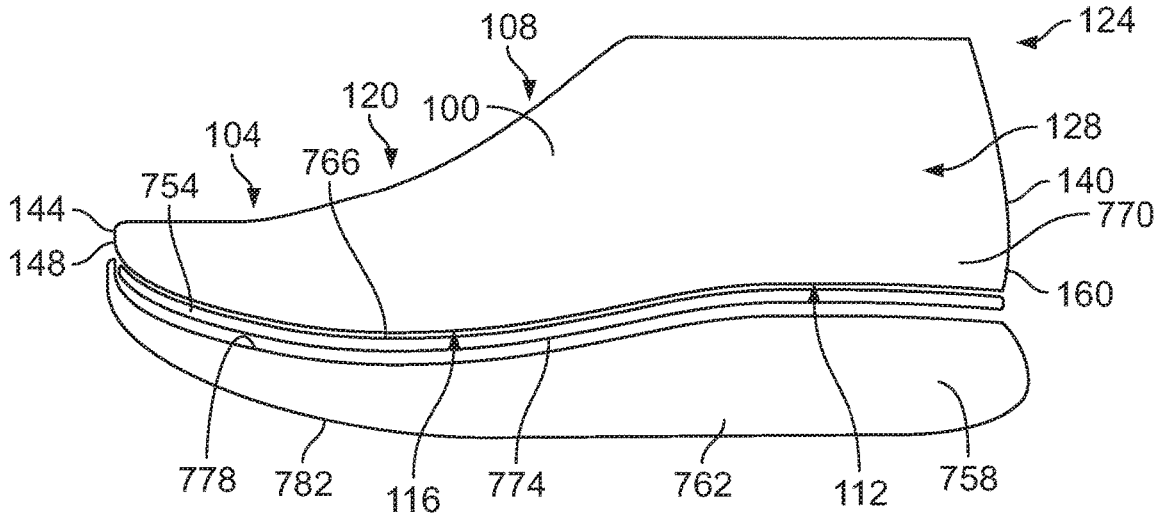
FIG. 25*b* is a left side elevational view of a last with a stiffening plate and a midsole, according to another embodiment of the present disclosure.
Figure 25C:
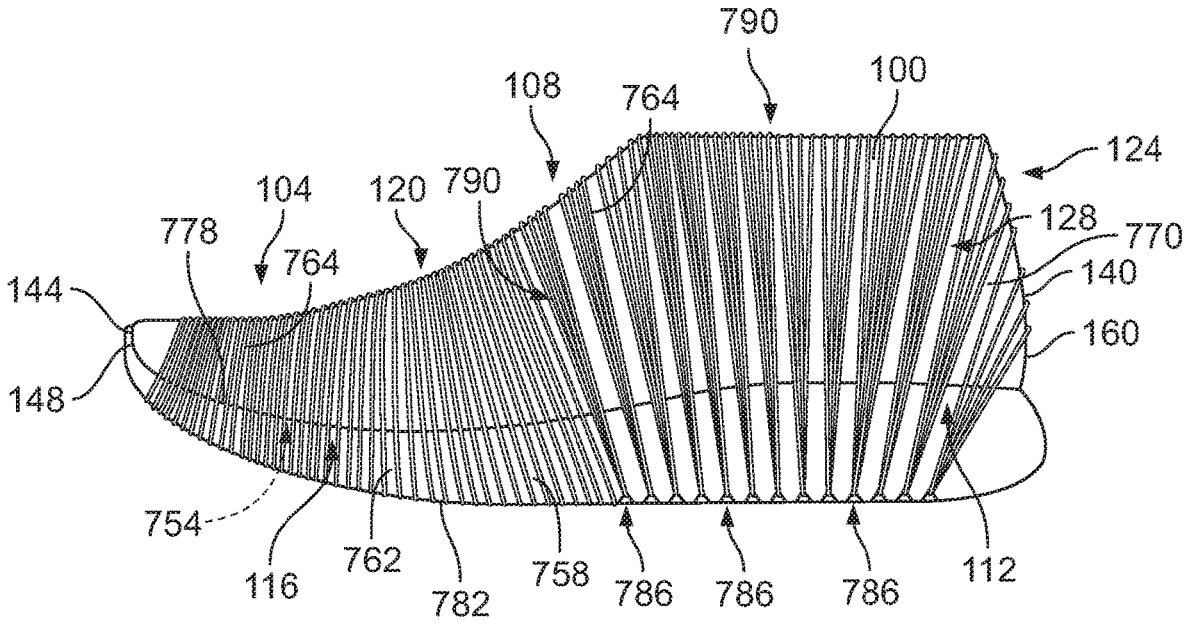
FIG. 25*c* is a left side elevational view of an article of footwear incorporating the stiffening plate and the midsole of FIG. 25*b* with a winding element disposed on the last of FIG. 25*b;*

Referring to FIGS. 25*b* and 25*c*, in some embodiments, an article of footwear may require a stiffening plate 754 disposed on or adjacent a sole structure 758 for providing stability and structure to the article of footwear. The stiffening plate 754 may be composed of one or more polymeric materials, such as, e.g., PEBAX® thermoplastic elastomer, polyvinyl chloride, and thermoplastic polyurethane. Additionally or alternatively, the stiffening plate 754 may be composed of composite materials, such as, e.g., carbon fiber and densified wood. Other examples of composite materials include, but are not limited to, materials having a polymer material, such as, e.g., epoxy, polyurethane, polyester, polypropylene, and vinyl ester, that enclose fibrous materials, such as, e.g., various filaments, fibers, yarns, and textiles that are formed from rayon, nylon, polyester, polyacrylic, silk, glass, boron, silicon carbide, carbon, aramids (e.g., para-aramid fibers and meta-aramid fibers), ultra-high molecular weight polyethylene, and liquid crystal polymers. The stiffening plate 754 and a midsole 762 may be temporarily or removably attached to the last 100, e.g., with mechanical fasteners, chemical fasteners, or other fastening means, before one or more continuous strands 764 (see FIG. 25*c*) are wound therearound. More specifically, referring to FIG. 25*b*, a first surface 766 of the stiffening plate 754 may project toward and contact an external surface 770 of the last 100, and an opposing second surface 774 thereof may project away from the last 100. An inner surface 778 of the midsole 762 may project toward and contact the second surface 774 of the stiffening plate 754, and an opposing outer surface 782 may project away from the last 100 and the stiffening plate 754. Turning to FIG. 25*c*, the one or more continuous strands 764 thus may be wrapped around the last 100, the stiffening plate 754, and the midsole 762 so that the one or more strands 764 contact the external surface 770 of the last 100 and the outer surface 782 of the midsole 762. In some embodiments, the outer surface 782 of the midsole 762 may include a plurality of recesses or grooves 786 for guiding and/or retaining the one or more continuous strands 764. Further, the one or more continuous strands 764 may be cured or stabilized to create a rigid, three-dimensional shape, i.e., a winding element 790, that couples the stiffening plate 754 and the midsole 762. In this way, manufacturing steps may be simplified because fabricating the winding element 790 simultaneously connects components of the article of footwear.

Some embodiments may require a stiffening plate in isolation, i.e., without a midsole. Thus, only the stiffening plate may be secured to the last, and a winding element may be formed therearound. The stiffening plate may include a plurality of recesses or grooves for guiding and/or retaining one or more continuous strands of the winding element during fabrication thereof. Additionally or alternatively, the stiffening plate may include one or more cleats or ground engaging members. In some instances, the stiffening plate may include fastening means, e.g., threaded holes, for securing one or more cleats or ground engaging members thereto. Once cured or stabilized, the winding element and the stiffening plate may be subsequently coupled to additional components, such as, e.g., an outsole. Furthermore, in some embodiments, an outsole may be provided adjacent the last, and a winding element may be created around the outsole. Therefore, one or more continuous strands may be disposed on an exterior surface of the outsole and be substantially exposed. Consequently, the strands may create a textured surface, thereby enhancing friction and/or grip of the outsole.

Figure 26:
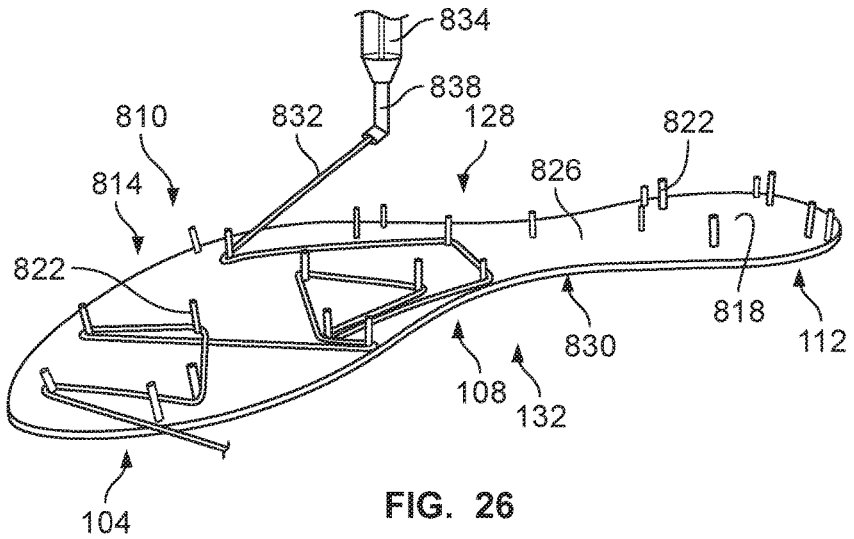
FIG. 26 is a left side perspective view of a winding element being formed on a plate, according to another embodiment of the present disclosure.
Figure 27:
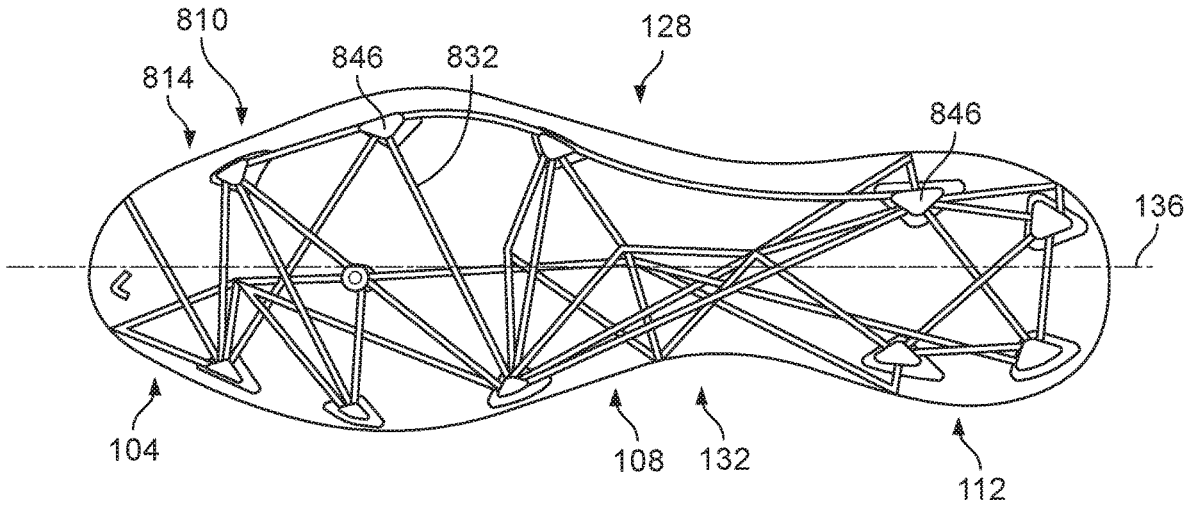
FIG. 27 is a top plan view of the winding element of FIG. 26 incorporated into a sole structure.

As discussed above, winding elements according to embodiments of the present disclosure may be configured for use in an article of footwear. For example, once cured or stabilized, the wounds elements 210, 310, 410 of FIGS. 5, 7, and 13, respectfully, may be used as uppers for articles of footwear. Embodiments of the present disclosure may additionally provide winding elements configured for use in a sole structure of an article of footwear. For example, FIGS. 26 and 27 illustrate a winding element 810 according to an embodiment of the present disclosure that is configured for use in a sole structure 814. In the illustrated embodiment, the winding element 810 is formed on a plate 818 having a plurality of pins 822, i.e., anchor points, disposed thereon. The plate 818 may generally be described similarly as the last 100 shown in FIGS. 2-4. For example, the plate 818 may similarly be defined by the lateral side 128, the medial side 132, the forefoot region 104, the midfoot region 108, and the heel region 112. The plate 818 further includes a first surface 826 opposing a second surface 830, the plurality of pins 822 extending from the first surface 826 away from second surface 830. Similar to winding elements formed on a last, the winding element 810 is created by winding at least one continuous strand 832 around the plurality of pins 822. The continuous strand 832 may be deposited onto the plate 818 by way of a thread supply system 834 comprising a movable arm 838. The continuous strand 832 may be wound so that it is taut between the pins 822. Once deposited onto the plate 818, the continuous strand 832 may be cured according to methods discussed herein, removed from the plate 818 and the pins 822, and subsequently incorporated into a sole structure of an article of footwear. In some embodiments, the winding element 810 may compose an entire sole structure. In some embodiments, the winding element 810 may accompany additional components to form a sole structure. For example, in some embodiments, the winding element 810 may be over-molded with a polymer material or disposed between a plurality of textile layers.

FIG. 27 illustrates the winding element 810 incorporated into a sole structure 814. The sole structure 814 includes a plurality of projections 846, i.e., cleats, that are configured to engage a ground surface. Therefore, the winding element 810 may be designed to accommodate and support the projections 846. More specifically, the pins 822 shown in FIG. 26 may be positioned on the plate 818 in locations that may substantially match locations of the projections 846 shown in FIG. 27. This configuration may be preferable because strand interaction may be increased in regions where the projections 846 will exist. Thus, when incorporated into the sole structure 814 having the projections 846, each of the projections 846 may correspond to areas of the winding element 810 having greater strand interaction and, thus, enhanced strength.

Figure 28:
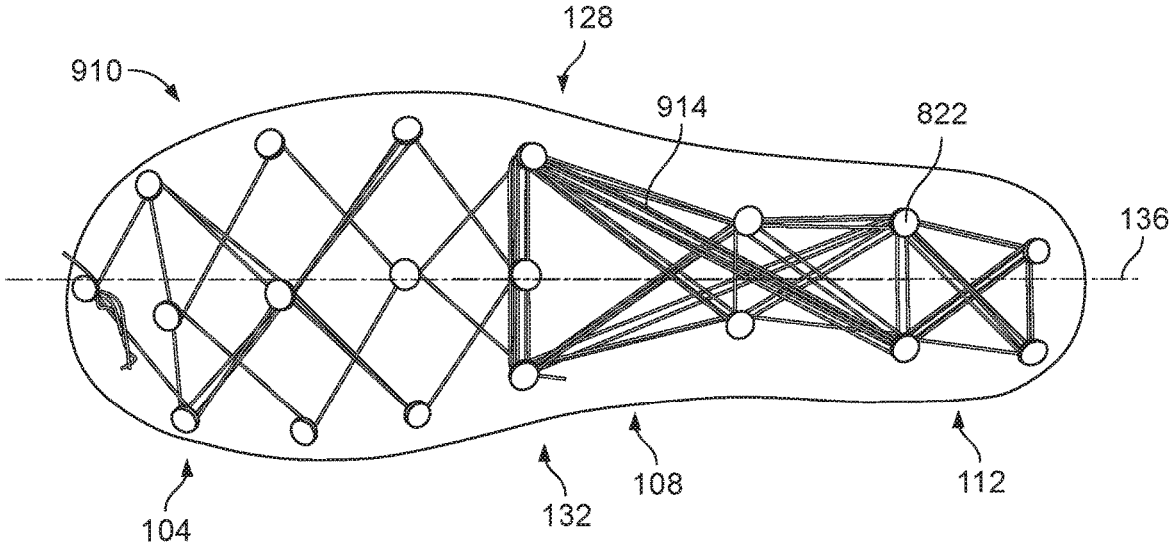
FIG. 28 is a top plan view of a winding element formed on a plate, according to another embodiment of the present disclosure.
Figure 29:
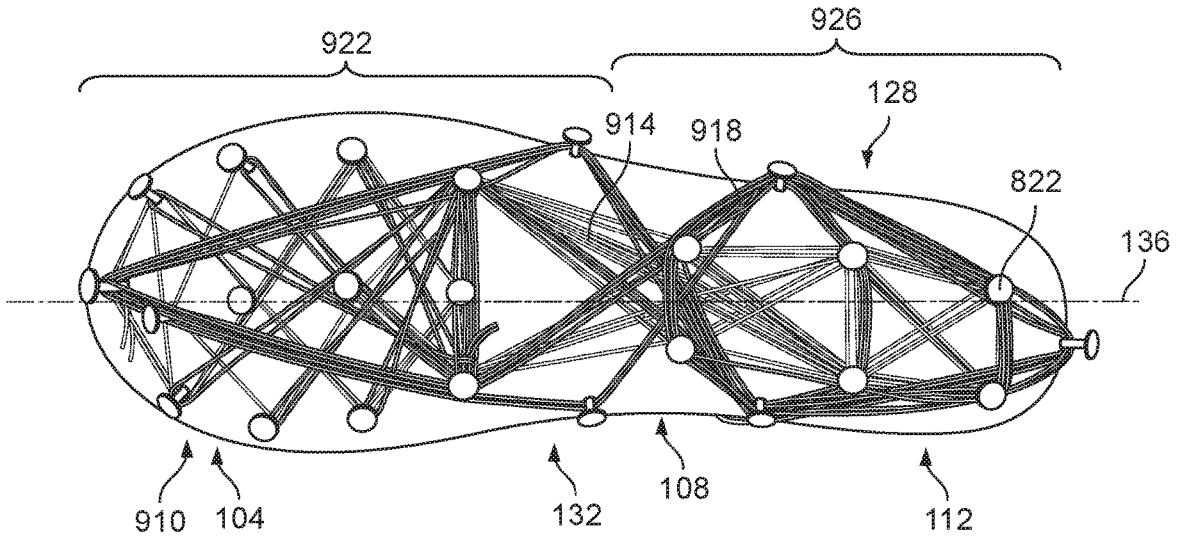
FIG. 29 is a top plan view of the winding element of FIG. 28 with a second continuous strand.

FIGS. 28 and 29 illustrate another winding element 910 configured for use in a sole structure. In this embodiment, a first continuous strand 914 is used to create a first portion of the winding element 910, and, with reference to FIG. 29, a second continuous strand 918 is used to create a second portion of the winding element 910. In this way, a sole structure may be designed with multiple performance properties. For example, in one embodiment, the first continuous strand may be composed of a material having a high tensile strength, such as, e.g., nylon or ultra-high-molecular-weight polyethylene fibers, whereas the second continuous strand may be composed of a material having a high elasticity, such as, e.g., latex. The resulting sole structure, therefore, may comprise zones having enhanced strength and/or elasticity. In the illustrated embodiment, the winding element 910 is configured to have a flexible zone 922, which includes strands arranged to allow for bending, e.g., angled relative to the longitudinal axis 136. The winding element 910 is further designed to have a stiff zone 926, which includes multiple layers of strands that are arranged to limit bending, e.g., extending substantially parallel to the longitudinal axis 136. Again, in some embodiments, winding elements for use in a sole structure, such as the winding element 910, may be over-molded to create a portion of a sole structure. Alternatively, winding elements may be layered with one or more other materials to create a sole structure, such as, e.g., layers made of fabric, plastic, silicone, or the like.

Figure 30:
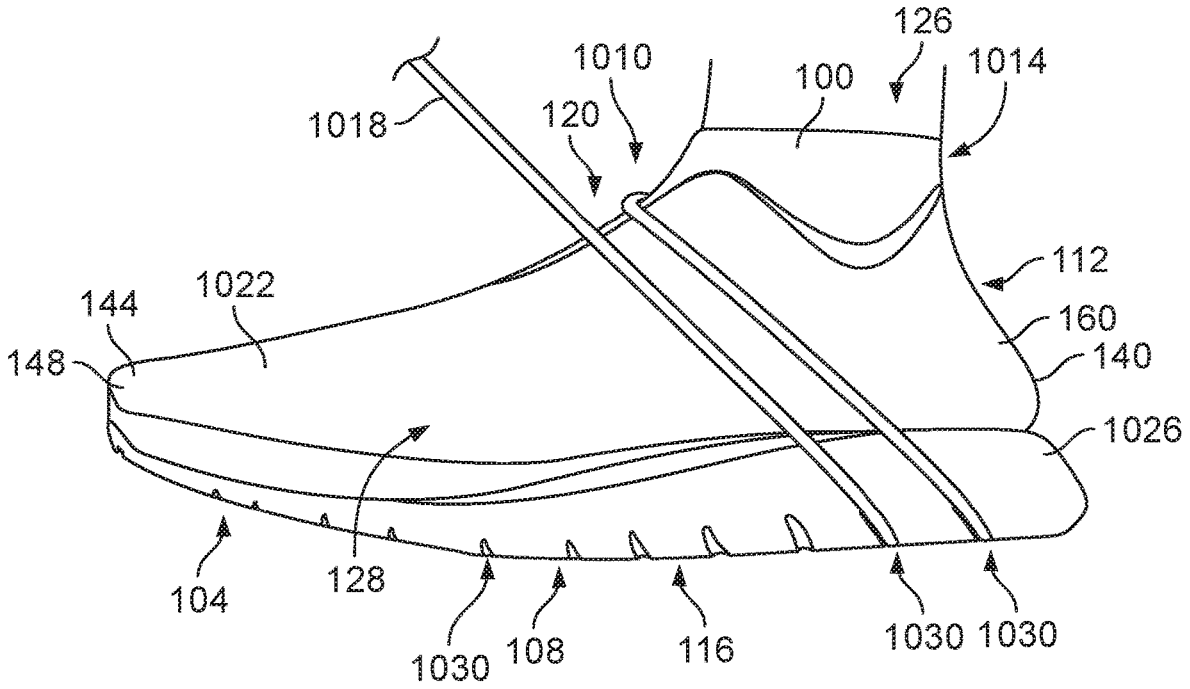
FIG. 30 is a left side elevational view of an article of footwear having a winding element according to another embodiment of the present disclosure.
Figure 31:
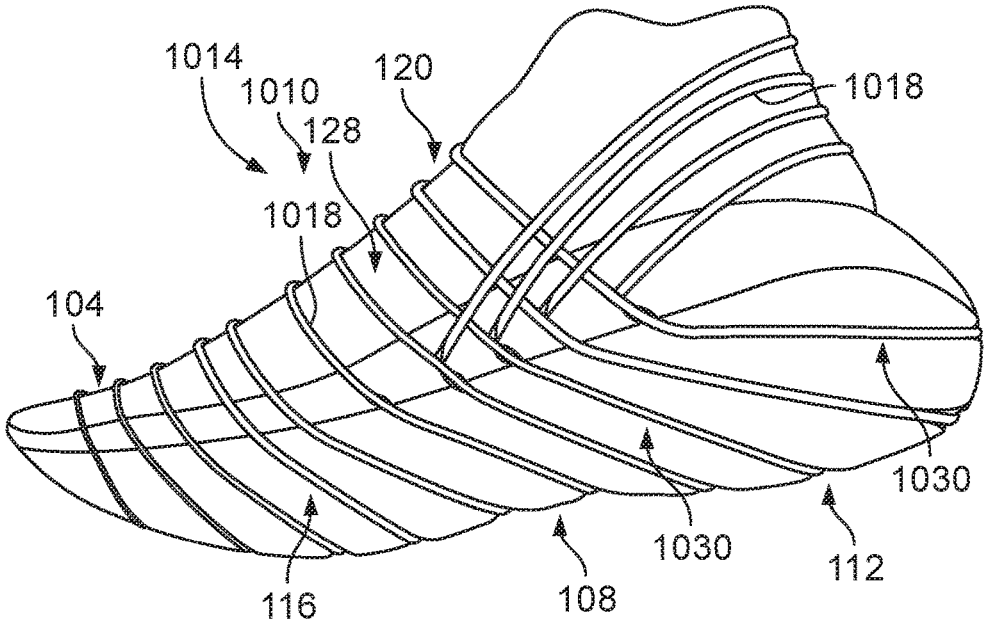
FIG. 31 is a left side perspective view of the article of footwear with the winding element of FIG. 30.

Embodiments of the present disclosure discussed thus far provide winding elements for use in an article of footwear as an upper or a sole structure. FIGS. 30 and 31 provide another example of a winding element 1010 for use in an article of footwear 1014. With reference to FIG. 30, one or more continuous strands 1018 may be wound around multiple components of the article of footwear 1014, such as an upper 1022 and a sole structure 1026. For example, the article of footwear 1014 may be individually fabricated and then arranged on the last 100, and the one or more continuous strands 1018 may be wound around the article of footwear 1014. In this way, the one or more continuous strands 1018 may assist in securing the upper 1022 to the sole structure 1026. In the illustrated embodiment, the sole structure 1026 includes a plurality of channels 1030 that extend laterally along a sole surface 1032 thereof and are configured to receive the one or more continuous strands 1022 when (or as) they are being wound around the article of footwear 1014. In some embodiments, a reinforcement component may be provided to secure the one or more continuous strands 1022 within the channels 1030. More specifically, in some embodiments, a reinforcement material, such as, e.g., a layer of polymeric resin, may be disposed within the channels 1030 and hardened to securely retain the strands 1022 within the channels 1030.

Turning to FIG. 31, the one or more continuous strands 1018 may be wound in a first direction along the midfoot region 108 and the forefoot region 104 of the last 100 and a second direction in the heel region 112 of the last. In the illustrated embodiment, the first direction and the second direction are substantially perpendicular to each other. The winding element 1010 in the illustrated embodiment may be provided for aesthetic purposes only, e.g., by incorporating various color schemes. Additionally or alternatively, the winding element 1010 may be provided to provide stiffness, strength, and/or protection. For example, the winding element 1010 may be composed of nylon to provide abrasion resistance. Further, the winding element 1010 may be composed of a high denier textile material to provide enhanced stiffness.

Figure 32:
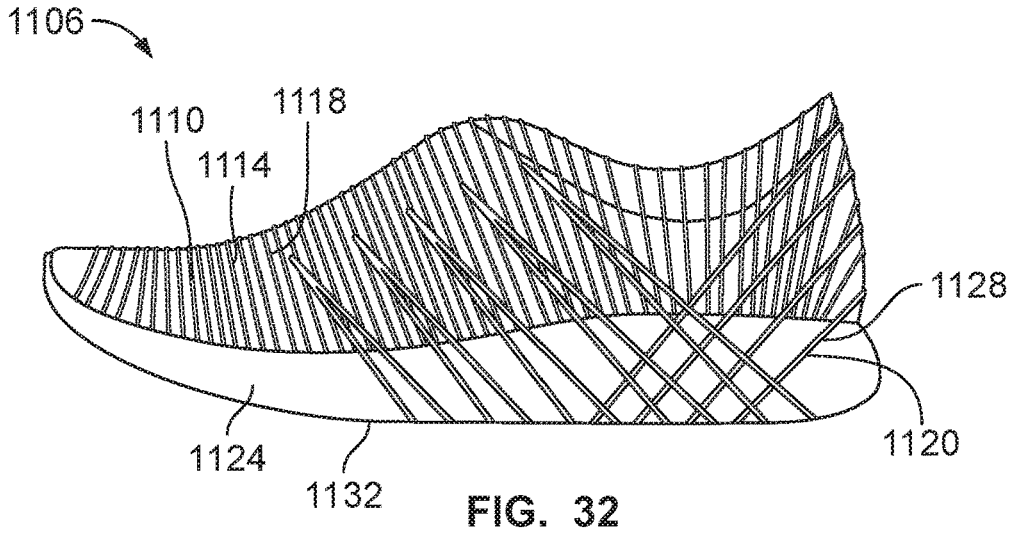
FIG. 32 is a left side elevational view of an article of footwear having a winding element according to another embodiment of the present disclosure.

FIG. 32 illustrates an article of footwear 1106 having a sole structure 1124 defining a forefoot region, a midfoot region, and a heel region, and that incorporates a plurality of winding elements. For example, the article of footwear 1106 includes a first winding element 1110 as an upper 1114. The first winding element 1110 is substantially similar to the winding element 510 of FIG. 21 having at least a first continuous strand 1118 wound such that it occupies a length of the article of footwear 1106 extending from the forefoot region to the heel region, thereby defining a first winding layer. In some aspects, the first continuous thread 1118 defines varying spacing between portions thereof from the forefoot region to the heel region, and the first continuous thread 1118 is non-self-intersecting along the length of the article of footwear 1106. In some aspects, the first continuous thread 1118 is non-self-intersecting along the forefoot region, the midfoot region, or the heel region. The article of footwear 1106 further includes a second winding element 1120 that is configured to couple the upper 1114 to the sole structure 1124. More specifically, similar to the winding element of FIG. 30, the second winding element 1120 may wrap around both the upper 1114 and the sole structure 1124 such that it contacts and adheres to surfaces of the upper 1114 and the sole structure 1124. The second winding element 1120 is used to form a second winding layer. The second winding element 1120 may include at least a second continuous strand 1128 that extends in a first direction. The first continuous strand 1118 extends in a second direction that is different from the first direction. In some aspects, a third continuous thread is further used to define the second winding layer. A plurality of peaks are defined along the midfoot region, or the plurality of peaks extends along the midfoot region and the forefoot region. The plurality of peaks defined by the second continuous thread 1128 each include a first leg that connects to a second leg such that each peak points in a direction that is upward with respect to the sole structure 1124 and away from the heel region. The strands 1118, 1128 may create a textured surface, thereby enhancing friction and/or grip of the sole structure 1124.

Figure 33:
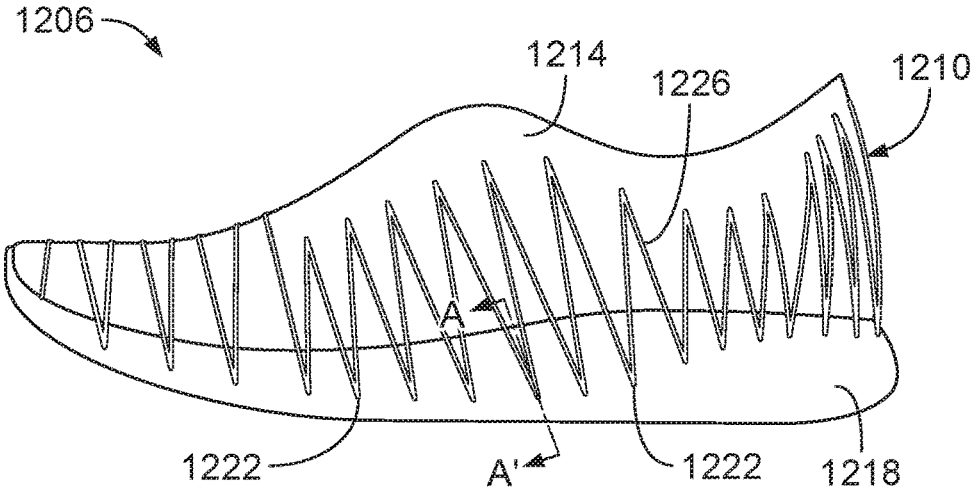
FIG. 33 is a left side elevational view of an article of footwear having a winding element according to another embodiment of the present disclosure.
Figure 34A:
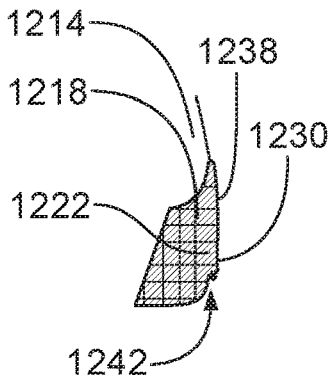
FIGS. 34*a* and 34*b* are a cross-sectional views taken along line A-A of FIG. 33.
Figure 34B:
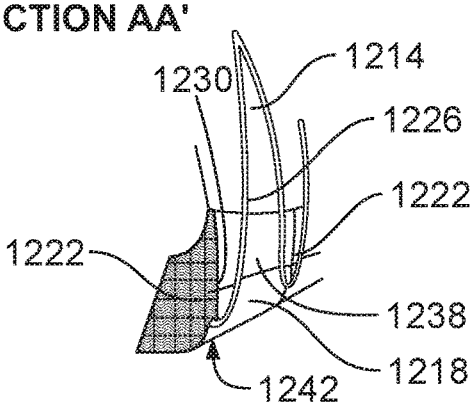

FIG. 33 provides another example of an article of footwear 1206 that incorporates a winding element 1210 that winds around both an upper 1214 and a sole structure 1218. The winding element 1210 may be substantially similar in design and functionality to the winding element 1010 of FIG. 30. In the illustrated embodiment, however, the sole structure 1218 includes a plurality of shelves 1222 that act as anchor points for at least one continuous strand 1226 to wrap around. More specifically, with reference to FIGS. 34*a* and 34*b*, each of the shelves 1222 is a protrusion 1230 that extends from a sidewall 1234 of the sole structure 1218. Thus, the one or more continuous strands 1226 may abut and be retained by a shelf surface 1242, thereby enabling the one or more continuous strands 1226 to change direction.

Figure 35:
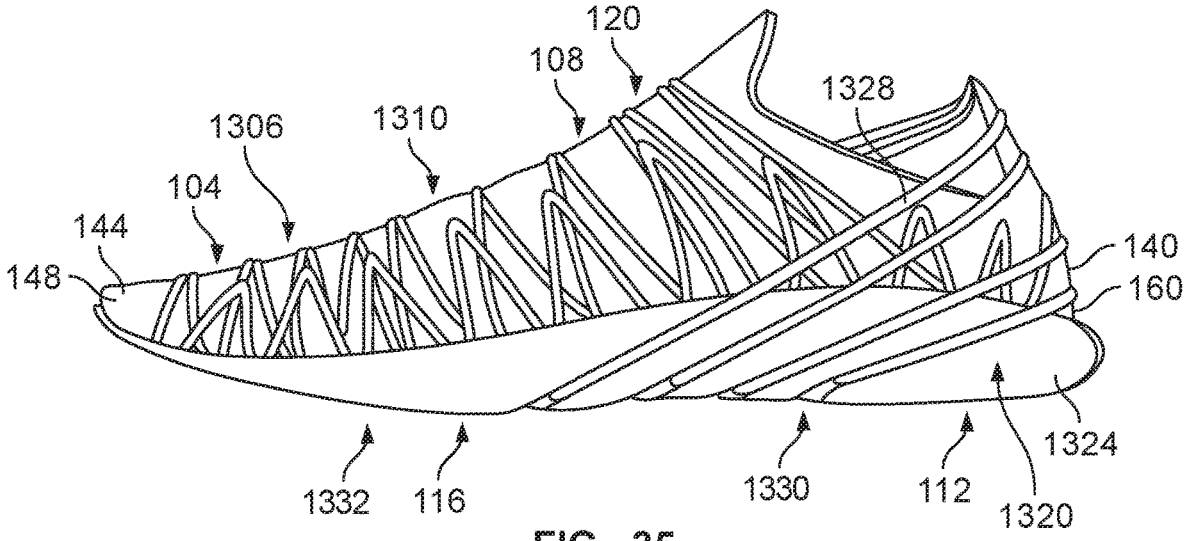
FIG. 35 is a left side elevational view of an article of footwear having winding elements according to another embodiment of the present disclosure.

FIG. 35 illustrates an article of footwear 1306 that incorporates multiple winding elements according to an embodiment of the present disclosure. For example, the article of footwear 1306 includes an upper winding element 1310 that is substantially similar to the winding element 610 of FIG. 22, and an outer winding element 1320 that is substantially similar to the winding element 1010 of FIGS. 30 and 31. The upper winding element 1310 is created as discussed above in relation to the winding element 610 of FIG. 22. Subsequently, the outer winding element 1320 may be coupled to a sole structure 1324, e.g., an outsole, and the upper winding element 1310 disposed thereon. Particularly, one or more continuous strands 1328 are wound around the upper winding element 1310 and the sole structure 1324 in a similar manner as the winding element 1010 of FIGS. 30 and 31, which are retained by a plurality of grooves 1330 defined by an outer surface 1332 of the sole structure 1324, and subsequently cured. As a result, the article of footwear 1306 is formed.

Any of the embodiments described herein may be modified to include any of the structures or methodologies disclosed in connection with different embodiments. Further, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the disclosure has been described above in connection with particular embodiments and examples, the disclosure is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. A method of manufacturing an article of footwear defining a forefoot region, a midfoot region, and a heel region, the method comprising:

providing a sole structure and a support structure, the sole structure defining an exterior surface;

winding a first continuous thread around the support structure to at least partially define an upper, the first continuous thread defining variable spacing between portions of the upper from the forefoot region to the heel region;

securing the first continuous thread;

winding a second continuous thread over the first continuous thread such that a plurality of peaks are defined by the second continuous thread along a side of the support structure in the midfoot region; and securing the second continuous thread, wherein the first continuous thread is non-self-intersecting and extends from the forefoot region to the heel region, wherein each individual peak of the plurality of peaks defined by the second continuous thread comprises a first leg and a second leg, the first leg connected to the second leg such that of the plurality of peak points in a direction upward from the sole structure and away from the heel region, and wherein the second continuous thread is configured to couple the upper to the sole structure.

2. The method of claim 1 further comprising providing a thread supply system, wherein the thread supply system is configured to provide the first continuous thread.

3. The method of claim 1 further comprising winding a third continuous thread around the support structure and around the sole structure.

4. A method of manufacturing an article of footwear defining a forefoot region, a midfoot region, and a heel region, the method comprising:

providing a support structure and a sole structure;

winding a first continuous thread around the support structure to at least partially define an upper, the first continuous thread defining variable spacing between portions of the upper from the forefoot region to the heel region; and winding a second continuous thread over the first continuous thread such that a plurality of peaks are defined by the second continuous thread along a side of the support structure in the midfoot region, wherein the first continuous thread is non-self-intersecting along the forefoot region, the midfoot region, or the heel region, wherein each individual peak of the plurality of peaks defined by the second continuous thread comprises a first leg and a second leg, the first leg connected to the second leg such that of the plurality of peaks points in a direction upward from the sole structure and away from the heel region, and wherein the second continuous thread is configured to couple the upper to the sole structure.

5. The method of claim 4, wherein the second continuous thread adheres to a surface of the upper and an exterior surface of the sole structure.

6. The method of claim 4, wherein the first continuous thread extends from a front distal end of the support structure to a rear distal end of the support structure.

7. The method of claim 4, wherein the second continuous thread defines a textured surface along an exterior surface of the sole structure.

8. A method of manufacturing an article of footwear defining a forefoot region, a midfoot region, and a heel region, the method comprising:

providing a support structure and a sole structure;

winding a first continuous thread around the support structure, the first continuous thread at least partially covering the forefoot region, the midfoot region, and the heel region of the support structure to at least partially define an upper; and winding a second continuous thread over the first continuous thread such that a plurality of peaks are defined by the second continuous thread along a side of the support structure in the midfoot region, wherein the second continuous thread couples the upper to the sole structure, wherein the first continuous thread is non-self-intersecting along the forefoot region, the midfoot region, or the heel region, and wherein each individual peak of the plurality of peaks defined by the second continuous thread comprises a first leg and a second leg, the first leg connected to the second leg such that of the plurality of peaks points in a direction upward from the sole structure and away from the heel region.

9. The method of claim 8, wherein the second continuous thread adheres to the upper and the sole structure.

10. The method of claim 8, wherein the first continuous thread substantially covers an outer surface of the support structure.

11. The method of claim 8 wherein the second continuous thread defines a textured surface along an exterior surface of the sole structure.

12. The method of claim 8 further comprising providing a thread supply system, wherein the thread supply system is configured to provide the first continuous thread.

13. The method of claim 8, wherein the second continuous thread is wound in a first direction and the first continuous thread extends in a second direction that is different from the first direction.

14. The method of claim 1 wherein the first continuous thread covers at least a portion of each of the forefoot region, the midfoot region, and the heel region.

15. The method of claim 1, wherein the second continuous thread adheres to the upper and to the exterior surface of the sole structure.

16. The method of claim 1, wherein the first continuous thread defines a first winding layer, and wherein the second continuous thread defines a second winding layer.

17. The method of claim 16, wherein the second winding layer is disposed on top of the first winding layer.

18. The method of claim 4, wherein the second continuous thread defines a second winding layer.

19. The method of claim 8, wherein the second continuous thread defines a second winding layer.

* * * * *